US005662480A

United States Patent [19]

Togashi

[11] Patent Number: 5,662,480

[45] Date of Patent: Sep. 2, 1997

[54] SURFACE MOUNT TYPE COAXIAL CONNECTOR CONNECTING COAXIAL CABLE TO SUBSTRATE

[75] Inventor: Kouji Togashi, Tokyo, Japan

[73] Assignee: SMK Co., Ltd., Tokyo, Japan

[21] Appl. No.: 459,996

[22] Filed: Jun. 2, 1995

[30] Foreign Application Priority Data

| | | | |
|---|---|---|---|
| Jun. 28, 1994 | [JP] | Japan | 6-167541 |
| Jul. 22, 1994 | [JP] | Japan | 6-192036 |
| Jul. 22, 1994 | [JP] | Japan | 6-192037 |

[51] Int. Cl.[6] ..... H01R 17/04

[52] U.S. Cl. ..... 439/63; 439/582

[58] Field of Search ..... 439/63, 394, 581, 439/582, 585

[56] References Cited

U.S. PATENT DOCUMENTS

| | | | |
|---|---|---|---|
| 5,190,474 | 3/1993 | Ginet | 439/581 |
| 5,542,861 | 8/1996 | Anhalt et al. | 439/585 |

FOREIGN PATENT DOCUMENTS 5-6755 1/1993 Japan .

*Primary Examiner*—Neil Abrams
*Attorney, Agent, or Firm*—Lowe, Price, LeBlanc & Becker

[57] ABSTRACT

In a surface-mounted type coaxial connector where a coaxial cable 10 and a substrate 12 are electrically connected by fitting the plug 44 connected to the coaxial cable 10 into the receptacle 80 surface-mounted on the substrate 12, a central contact 51 of a plug 44 is made from a male contact and a central contact 82 of the receptacle 80 is made from a female contact reducing thus the height Hp of a shell 46 of the plug 44. As necessity arises, the electrical connection of the central conductor 18 of the coaxial cable 10 is positioned opposite the attaching portion of the plug 44 with the coaxial cable 10 as seen from the central contact 51, reducing thus the length Lp of the shield cover 45 of the plug 44. The respective parts of the central conductor 18 and a braid 20 of the coaxial cable 10 are sequentially exposed with the exposed braid 20 folded over the outside of the sleeve 56 fitted into the outside of the casing 27 and the braid crimp portion 49 of the shield cover 45 is crimped into the outside of the folded braid 19 to reduce the Lp. The central contact 82 and shell 83 of the receptacle 80 are crimped and fastened from one side (e.g., from bottom) of the insulator 81. The top plane S on the plug fitting side of the insulator 81 of the receptacle 80 is formed outside or on the same plane with the top plane on the plug fitting side of the shell 83.

6 Claims, 20 Drawing Sheets

45
46
48
49
50
61
62
62a
63
64
65
66
67
A
B 51
52
76
75
18
19
10

SURFACE MOUNT TYPE COAXIAL CONNECTOR CONNECTING COAXIAL CABLE TO SUBSTRATE

BACKGROUND OF THE INVENTION (1) Field of the Invention

This invention relates to a surface mount technology type coaxial connector, for instance, ultra miniature high frequency coaxial connector that connects a coaxial cable with a substrate and is used in such high frequency communication equipment as portable phone and automobile telephone.

(2) Description of the Prior Art

Conventionally this type of surface-mounted coaxial connector was composed as described in the Provisional Publication No. 6755-1993 laid open Jan. 29, 1993. In this prior art the coaxial connector comprises a plug 11 connected to one end of a coaxial cable and a receptacle 13 surface-mounted on a substrate (for example, on a printed circuit board) as shown in FIG. 1, and the coaxial cable 10 and substrate 12 are electrically connected by fitting the plug 11 into the receptacle 13.

As shown in FIG. 2, the plug 11 is provided with a laterally L-shaped insulator 14 whose top is formed into a cylindrical fitting portion 15 at the center of which is mounted a central contact 16 made from a female type contact. The conductor crimp portion 17 of this central contact 16 crimp the central conductor 18 of the coaxial cable 10. The term "crimp" in this and later contexts means that members are fastened together under certain pressure so as not to separate them. The coaxial cable 10 is covered outside the central conductor 18 sequentially with a cylindrical insulator 19, a braid 20 as shielded conductor and casing 27.

The insulator 14 is covered with the shield cover 22 that is a shielding member, the top portion of which is formed into a cylindrical shell 23. An annular insertion 24 is constructed between the shell 23 and the fitting portion 15 of the insulator 14. On the bottom portion of the shield cover 22, formed sequentially are the insulator crimp portion 25 crimped into the outer portion of the braid 20 of the coaxial cable 10, and the casing crimp portion crimped into the outside portion of the casing 27 of the coaxial cable 10.

The receptacle 13 that is composed of the insulator 29, shell 30 and the central contact 31 as shown in FIG. 3 (*a*), (*b*), and (*c*) is assembled as follows. As shown in FIG. 4, the shell 30 is inserted from the upper part of the insulator 29, the cylindrical shell 32 of the shell 30 is fitted into the outer circumference of the projection formed at the center of the concave depression 33 of the insulator 29 while press-fitting the terminals 35, 35 and 35 into ports 36, 36, and 36 to be projected on the lower face, and these terminals 35, 35, and 35 thus projected are folded outward into the notches 37, 37, and 37 to form the grounding terminals. In this text, the term "fitting" means fitting two objects into each other, and the term "press-fit" means putting something into another thing pressing it against some pressure.

On the other hand the central contact 31 is inserted from the lower portion of the insulator 29, the contact portion 38 of the central contact is inserted into the contact insertion bore 39 of the insulator 29, and the leg 40 of the central contact is inserted into the groove 41 of the insulator 29 to form the hot terminal.

Then, as shown in FIG. 5, the receptacle 13 is automatically mounted on the substrate 12 by means of the adsorption nozzle of an automatic mounting machine. Then, by fitting into the shell 32 of the receptacle 13 the shell 23 of the plug 11 shown in FIG. 2, the central contact 16 and shell 23 of the plug 11 fit into and contact the central contact 31 and shell 32 of the receptacle 13, connecting thus the coaxial cable 10 electrically with the substrate 12.

In another example of prior art, there existed a sleeve 21 inserted between the cylindrical insulator 19 and the braid 20 outside the cylindrical insulator 19 in the coaxial cable 10 as shown in FIG. 6. This sleeve 21 is made of, for instance, from phosphor bronze so as to endow it with conductivity. In FIG. 6 the numeral 59 symbolizes that locking spring mounted outside the shell 23 which reinforces the elasticity of the shell 23. Other configurations being nearly the same with those shown in FIG. 2, explanation will be omitted with like numerals representing the like portions for short.

The surface mount type coaxial connector in the prior art was however problematical in that, the central contact 16 of the plug 11 being made from a female contact having a slit intended to give some plasticity, the central contact 16 of the plug 11 was too long and consequently the height Hp of the shield cover 22 was too large, making thus it difficult to save space.

Another problematical point was that the length Lp was too large (for example, Lp=7 mm) from the center line 43 to the bottom end of the shield cover 22 due to the conductor crimp portion 17 of the central contact 16 in the plug 11 that was formed on the coaxial cable 10 from the center line 43 and to the casing crimp portion 28 that was provided besides the braid crimp portion 26. Space-saving was difficult in this case too.

Though it is conceivable to reduce the length Lp by omitting one of the two: the braid crimp portion 26 and the casing crimp portion 28, this omission would weaken the crimp force between the shield cover 22 and the coaxial cable 10 in the plug 11 because of the level difference between the braid 20 and the casing 27 in the coaxial cable 10.

On the other hand, the assembling workability is worse, because the direction of incorporation is reversed of the shell body 30 and central contact 31 to be press-fitted and fixed onto the insulator 29 as shown in FIG. 4, and consequently the terminals 35, 35, and 35 are folded outward after the press-fitting of the shell body 30 into the insulator 29.

Since further the top face on the plug fitting side of the insulator 29 in the receptacle 13 was designed to be situated inward (that is, on the side of the substrate 12) from the top face on the plug fitting side of the shell body 30, the dimension of the adsorption nozzle 42 of the automatic mounting machine was limited, thereby reducing the degree of freedom in designing the nozzle, lessening the contact area with the nozzle 42 and worsening the adsorption stability under high-speed mounting.

The adsorption nozzle is subjected to a large dimensional restriction, because, as shown in FIG. 5, the outer diameter G of the adsorption nozzle 42 should be larger than the inner diameter D of the shell body 30 (G>D) and that the inner diameter N of the nozzle 42, namely the inner diameter N of the inlet port should be equal to or less than the outer diameter C of the shell body 30 ($N \leqq C$). Since, moreover, the contact is only between the top face of the shell 30 and the top face of the adsorption nozzle 42, the contact area for adsorption becomes necessarily smaller.

As is shown by the dotted line in FIG. 5, some prior art makes airtight the adsorption cover 44 outside the shell body 30 or bonds an adsorption tape on the shell body 30 in order to enlarge the adsorption area with the adsorption nozzle 42.

These adoptions however worsen the assembling workability because additional work is required to remove the adsorption cover 44 and the adsorption tape after mounting the receptacle on the substrate 12 in addition to the requirement of these cover and tape.

BRIEF SUMMARY OF THE INVENTION

The primary object of this invention is to form the central contact of the plug connected to a coaxial cable from a male type contact and to make the central contact of the receptacle surface-mounted on the substrate from a female type contact to reduce the height Hp of the shell of the shield cover in the plug and the height of the surface-mounted type coaxial connector from the substrate face enabling thus favorable space-saving.

The second object of this invention is to form the electrical connection between the central contact of the plug and the central conductor of the coaxial cable at a position opposite the fixation portion of the plug with the coaxial cable as seen from the central contact to reduce the distance Lp from the center line of the shell of the shield cover in the plug to the bottom end of the shield cover thereby contributing to the space-saving.

The third object of this invention is to expose sequentially the respective parts of the central conductor and braid on the plug connection side in the coaxial cable and fold over the braid thus exposed on the outer portion of the sleeve fitted into the outer portion of the casing, crimping the braid press-fit portion of the shield cover into the outer portion of the folded braid, thus reducing the distance from the center line of the shell of the shield cover in the plug to the bottom end of the shield cover for space-saving.

The fourth purpose of this invention is to enhance the assembling workability by crimping and fastening both the central contact and shell in the receptacle into one plane side (for example, bottom side) of the insulator.

The fifth purpose of the invention is to form the top face on the plug fitting side of the insulator into planar shape positioned outside the top face on the plug fitting side of the shell to enlarge the contact area of the automatic mounter with the adsorption nozzle without employing the adsorption tape and adsorption cover and raise the degree of freedom in designing the adsorption nozzle and improve the adsorption stability under high-speed mounting.

The sixth purpose of this invention is to form the top face on the plug fitting side of the insulator into planar shape positioned at the same level with the top face on the plug fitting side of the shell to enlarge the contact area of the automatic mounter with the adsorption nozzle without employing the adsorption tape and adsorption cover and raise the degree of freedom in designing the adsorption nozzle and improve the adsorption stability under high-speed mounting.

DETAILED DESCRIPTION

Referring now to FIG. 7 to FIG. 21 through, we will explain the first embodiment of the surface mount type coaxial connector that connects the coaxial cable to the substrate according to this invention.

The coaxial connector by this invention consists of the plug 44 connected to the coaxial cable 10 and the receptacle 80 surface-mounted on the substrate. First the plug 44 connected to the coaxial cable 10 will be explained referring to FIGS. 7 to 14. In these figures like numerals represent like parts in FIGS. 1 to 6.

Figure 7:
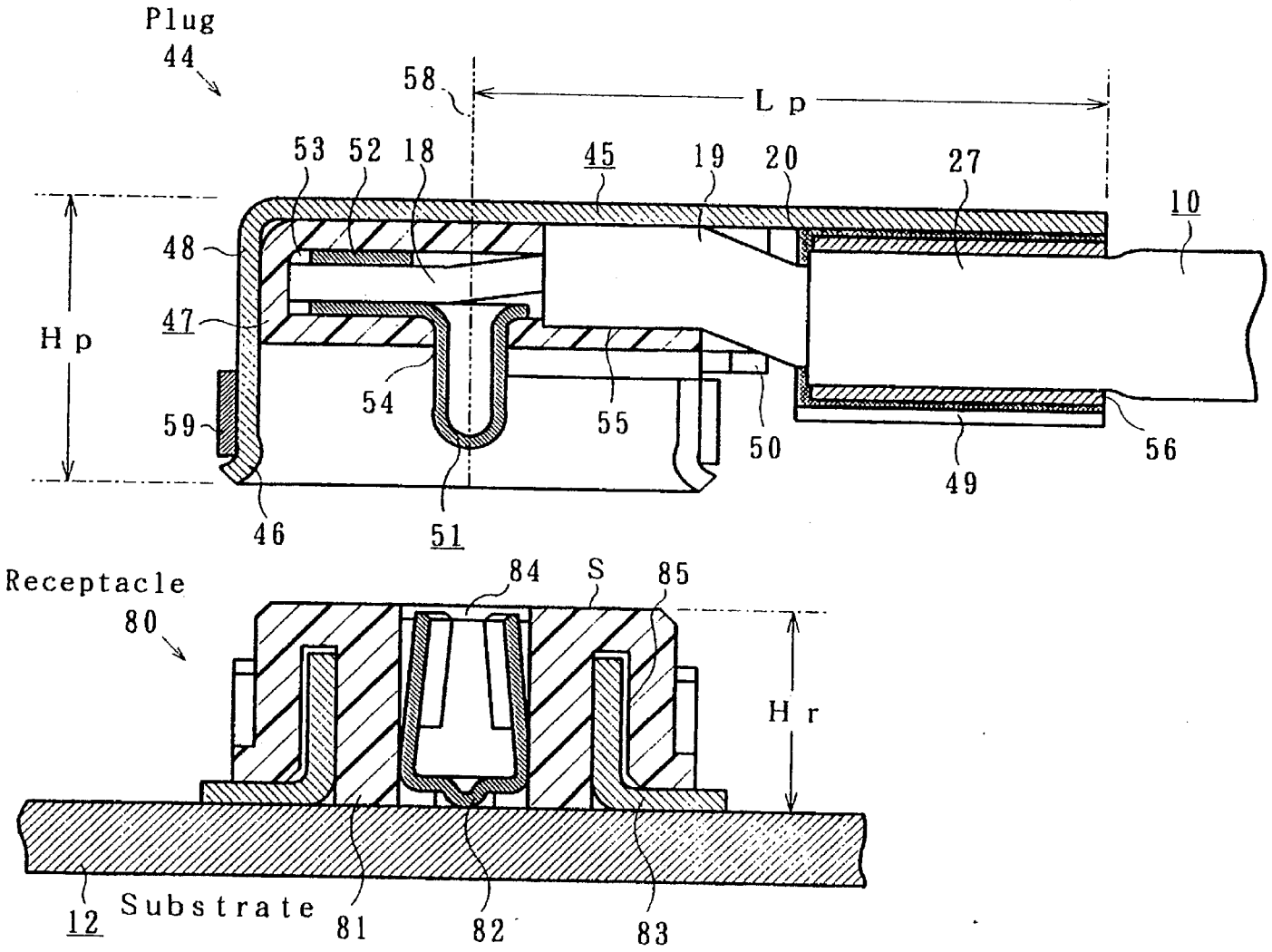
FIG. 7 is a cross-sectional view showing an embodiment of surface mount type coaxial connector that connects a coaxial cable to a substrate, where the plug is represented in an enlarged A—A cross-sectional view of FIG. 8(*a*) and the receptacle in an enlarged A—A cross-sectional view of FIG. 15(*a*).
Figure 8A:
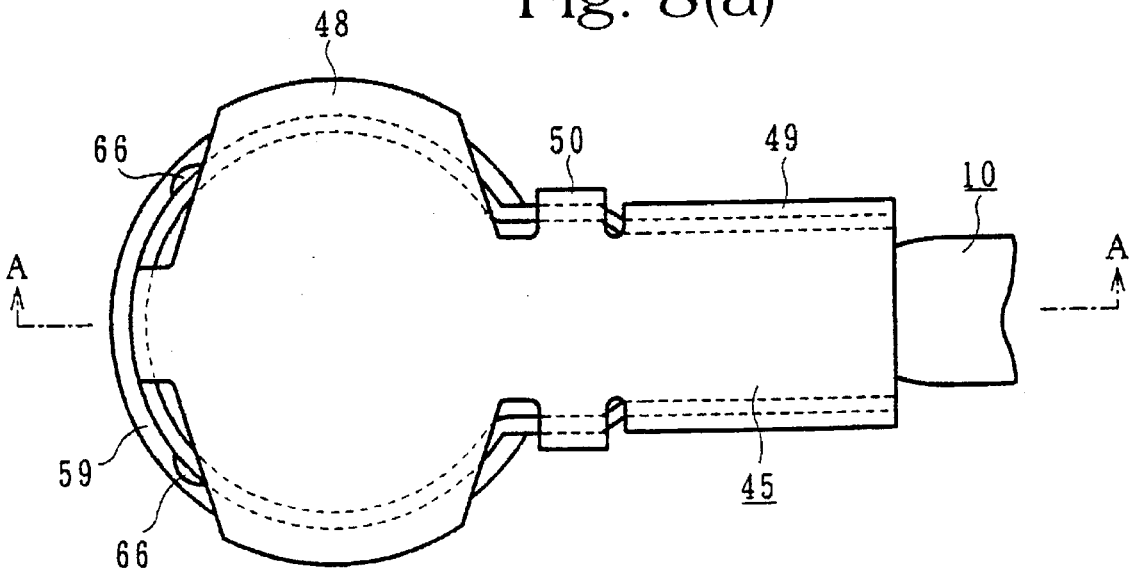
FIG. 8 illustrates the plug as shown in FIG. 7 in which (a) is a plan view, (b) a frontal elevation view and (c) a bottom plan view.
Figure 8B:
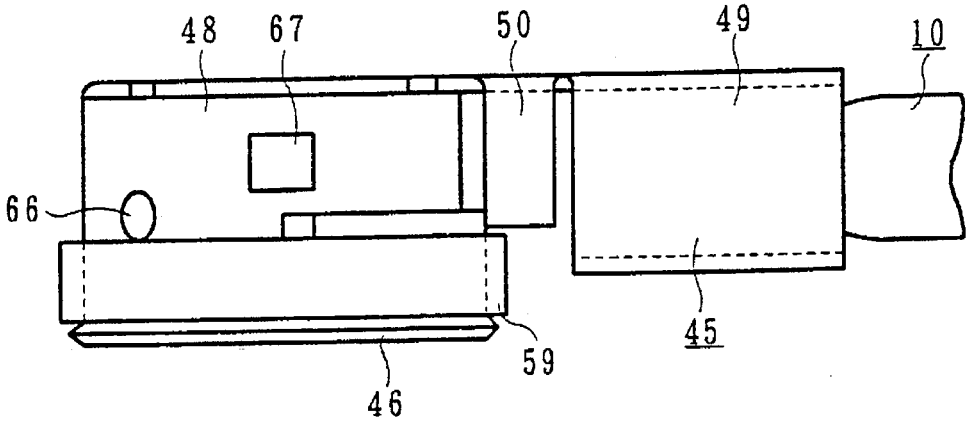
Figure 8C:
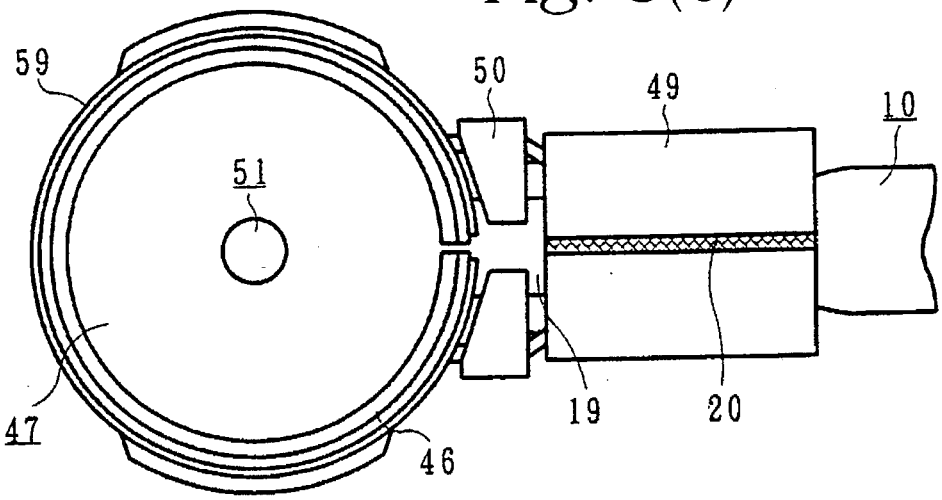
Figure 9A:
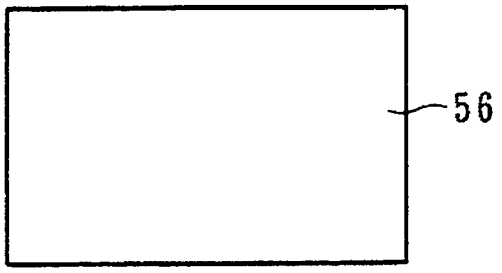
FIG. 9 shows an enlarged view of the sleeve of the plug as shown in FIG. 7, in which (a) is a frontal elevation view, (b) a right side elevation, and (c) a bottom plan view.
Figure 9B:
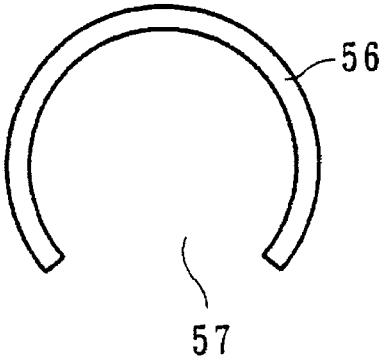
Figure 9C:
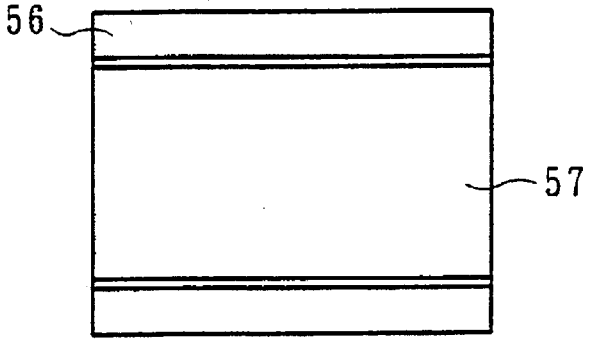

In FIGS. 7 and 8, the numeral 10 denotes a coaxial cable and the numeral 45 is a shield cover. The shield cover 45 is made from conductive material (for example, phosphor bronze) into predetermined geometrical shape. On the top portion of the shield cover 45, a cylindrical shell 46 and the insulator housing and holding portion 48 for the insulator 47 are constructed into one piece as a fitting portion, and on the bottom of the cover 45 a braid crimp portion 49 is made into one piece. Formed into one piece on the intermediate portion is the insulator crimp portion 50 that crimps the insulator 47 into the insulator 19 of the coaxial cable 19.

The numeral 51 represents a central contact composed of a male contact. The base of this central contact 51 and the conductor crimp portion 52 are housed and held in the housing 53 formed in the insulator 47. The edge of the central contact 51 is projected into the shell 46 through the contact insertion port of the insulator 47. The exposed portion of the insulator 19 of the coaxial cable 10 is housed and held between the concave housing 55 and the insulator holding portion 48.

The coaxial cable 10 has been constructed by being sequentially covered outside the central conductor 18 by a cylindrical insulator 19, a braid 20 and a casing 27. As shown in FIG. 7, the respective parts of the central conductor 18 and insulator 19 are sequentially exposed from the fixed side of the plug 44, and the braid 20 which was outside the exposed insulator 19 has been folded over outside the sleeve 56 which has been crimped beforehand by caulking on the outer portion of the casing 27.

The braid 20 has been made from, for example, braided thin copper wire which has covered the outer portion of the insulator 19. The casing 27 has been formed by covering the outer periphery of the braid with, for example, an insulating material (vinyl or polyethylene). As has been shown in FIG. 9 (*a*), (*b*) and (*c*), the sleeve 56 is formed into cylindrical shape having a wide slit 57.

Press-fitt to the outside of the folded braid 20 is the braid crimp portion 49 of the shield cover 45. Since the braid crimp portion 49 crimps the outside of the casing 27 with the braid 20 inserted between itself and the sleeve 56, crimping of the braid crimp portion 49 alone gives a sufficient crimping force between the coaxial cable 10 and the shield cover 45. Hence the casing crimp portion required in the prior art may be omitted enabling thus to reduce the length Lp from the center line 56 of the central contact 51 to the bottom edge of the shield cover.

Crimping the conductor crimp portion 52 of the central contact 51 onto the central conductor 18 exposed on the top side of the coaxial cable 10 makes an electrical connection therebetween. Because the central conductor 18 of the coaxial cable 10 goes across the center line 58 of the central contact 51, and connects with the conductor crimp portion 52 of the central contact 51 at the position opposite the braid crimp portion 49, the length $L_p$ can be shorter from the center line 58 of the central contact 51 to the bottom edge of the shield cover 45 than in the prior art. In an embodiment as shown in FIG. 7, for instance, a sufficient crimp force could be obtained between the coaxial cable 19 and the shield cover 45 even with 5 mm Lp, while about 7 mm of Lp was required in the prior art.

Figure 10A:
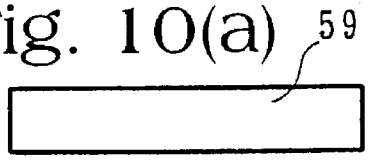
FIG. 10 represents, in reduced scale, the locking spring as shown in FIG. 8, in which (a) is a frontal elevation view, (b) a right side elevation, and (c) a bottom plan view.
Figure 10B:
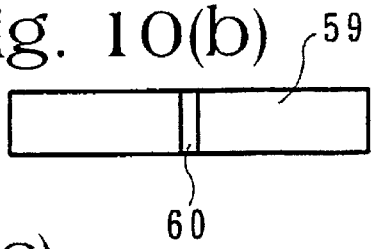
Figure 10C:
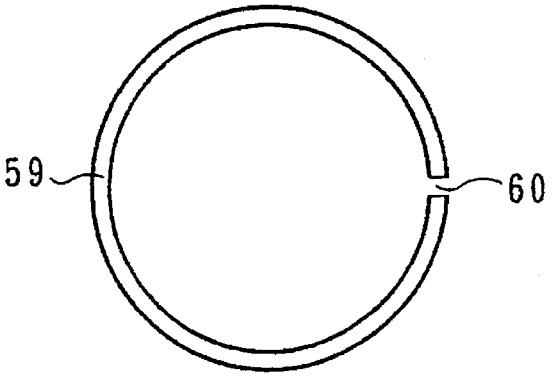

A locking spring 59 intended to reinforce the elasticity of the shell 46 of the shield cover 45 has been mounted on the outside of this shell 46. The locking spring 59 has been formed into ring shape having a slit 60 as shown in FIG. 10 (*a*), (*b*) and (*c*).

Figures 11A, 11B, 11C, 11D, 11E:
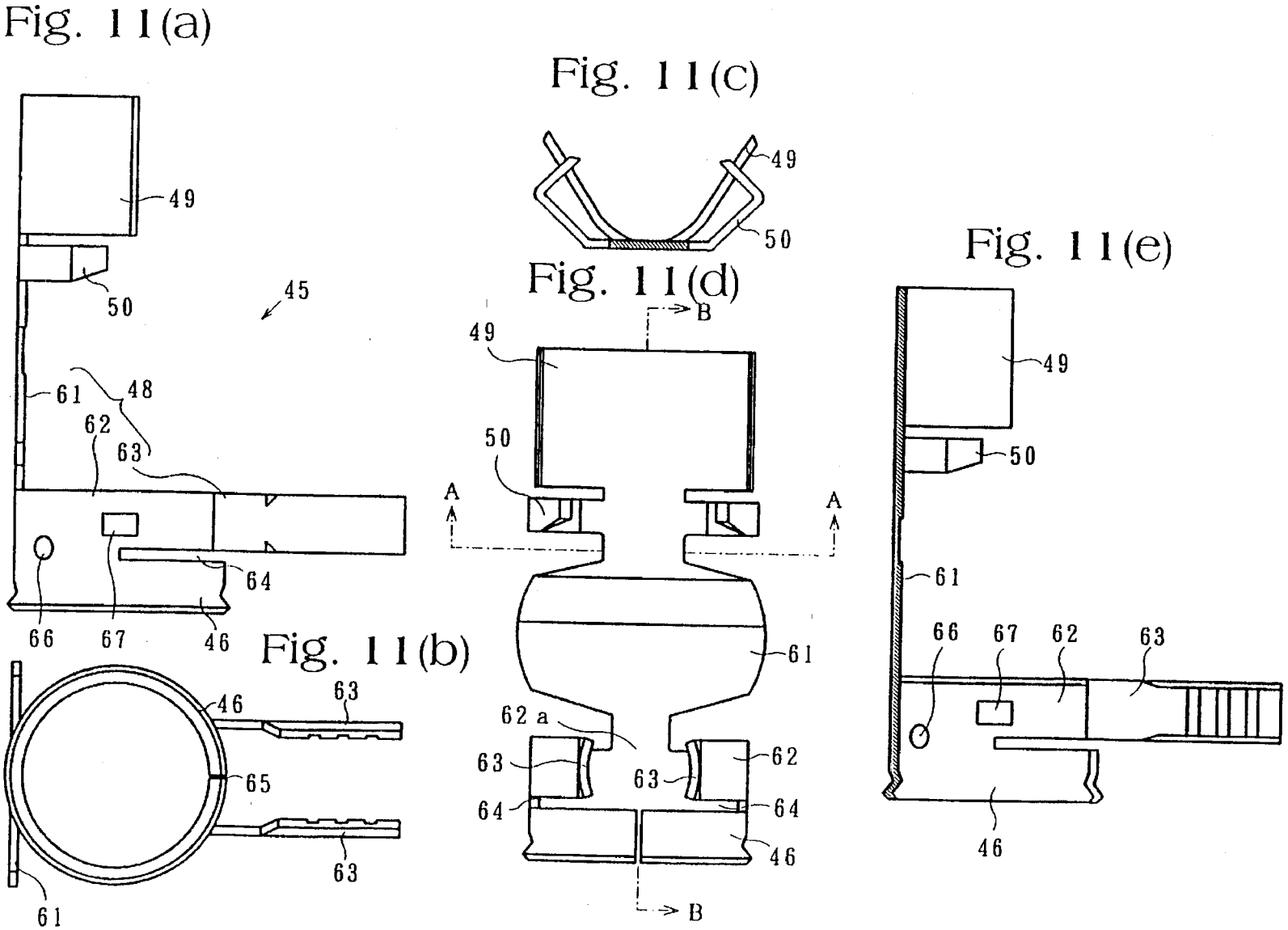
FIG. 11 depicts, in reduced scale, the shield cover as shown in FIG. 8 before its assembling, in which (a) is a frontal elevation view, (b) a bottom plan view, (c) an A—A cross-sectional view of (d), (d) a plan view, and (e) a B—B cross-sectional view of (d).
Figure 12A:
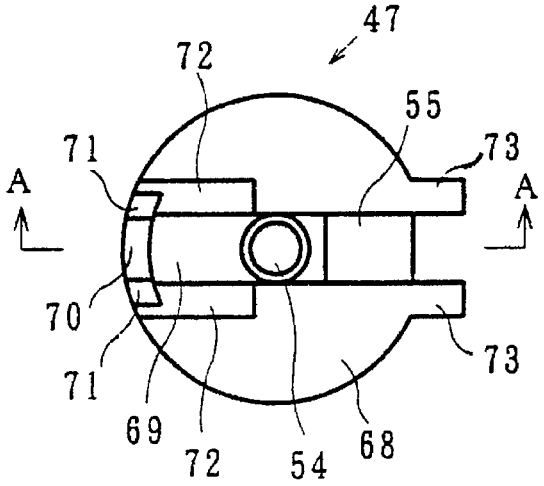
FIG. 12 illustrates, in reduced scale, the insulator as shown in FIG. 8 before its assembling, in which (a) is a plan view, (b) a frontal elevation view, (c) a bottom plan view, (d) a left side elevation view of (b), (e) a right side elevation view, and (f) an A—A cross-sectional view of (a).
Figure 12D:
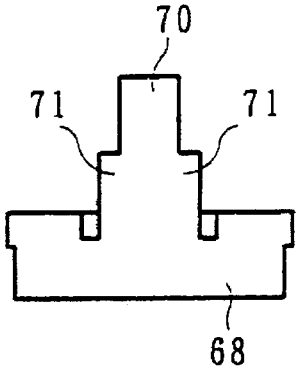
Figure 12B:
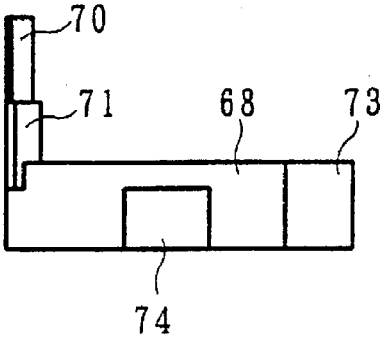
Figure 12E:
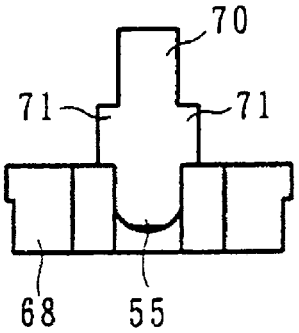
Figure 12C:
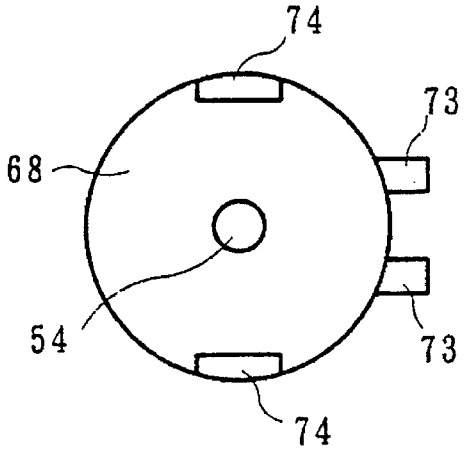
Figure 12F:
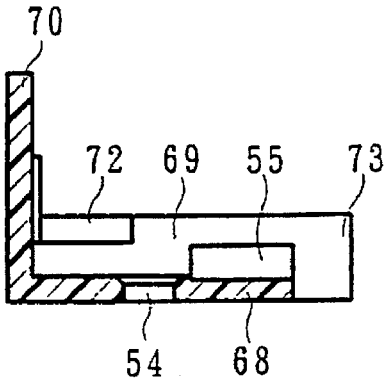

Before assembling the shield cover 45 is constructed as shown in FIG. 11 (*a*) through (*e*). That is, the shield cover 45 comprises the lid plate 61 in the form of a disk with its upper and lower shoulders cut off, a cylindrical body 62 formed, under this lid plate 61, into one piece through intermediary of a connecting plate (this cylindrical body 62 having a wide slit 62*a*), a pressure piece 63 extending, as one piece, from the side walls of the wide slit 62*a* of the cylindrical body 62, the cylindrical shell 46 connected into one piece under the lid plate 61 through intermediary of the skit grooves 64 and 64, and finally the insulator crimp portion 50 and the braid crimp portion 49 that have been sequentially formed into one piece above the lid plate 61 through intermediary of the connecting plate. A narrow slit 65 has been formed at the shell 46.

The cylindrical body 62 and the shell 46 have been designed so that their central axes should be parallel with the plane of the lid plate 61. Formed at the cylindrical body 62 have been the convex engagement portions 66 and 66 bulging from the inner wall face to the outer wall face, and the convex mating portions 67 and 67 bulging out from the outer wall side to the inner wall side. The lid plate 61, cylindrical body 62 and pressure pieces 63 and 63 build up the insulator holding portion 48.

Before assembling, the insulator 47 has been formed as shown in FIG. 12 (*a*) to (*f*). That is, the insulator 47 has, at its central part, a disk-like body 68 having the contact insertion hole 54. Formed on the upper face of this body 68 are the concave housing portion 69 drilled from almost central part to the left side as shown in the plan view in FIG. 12 (*a*) and the concave housing portion 55 drilled from almost central part to the right side and in communication with the concave housing portion 69. The bottom of the concave housing portion 69 is formed into planar shape and communicates with the contact insertion hole 54, while the bottom of the concave housing portion 55 is shaped into semicircular form.

Formed on the upper face of the body 68 is a tongue for folding 70 which is made into one piece with the body 68 and perpendicular to its plate face. The folding tongue 70 is designed to be positioned at the leftmost point of the concave housing portion 69 as shown in the plan view of FIG. 12 (*a*). Formed into one piece with, and on both lower sides of, the tongue 70 are engaging pieces 71 and 71, while engaging steps 72 and 72 are provided on the upper portion of the side walls of the concave housing portion 69 to fasten the engaging pieces 71 and 71.

Formed on the outer face of, and into one piece with, the body 68 are the guide pieces 73 and 73 projecting outward (namely, to the right-hand side in FIG. 12 (*a*)) from both edges of the lateral opening of the concave housing portion 55. Further on the outer face of the body 68 the concave engaging portions 74 and 74 are provided to engage with the convex engaging portions 67 and 67 of the shield cover 45.

Figures 13A, 13B, 13C:
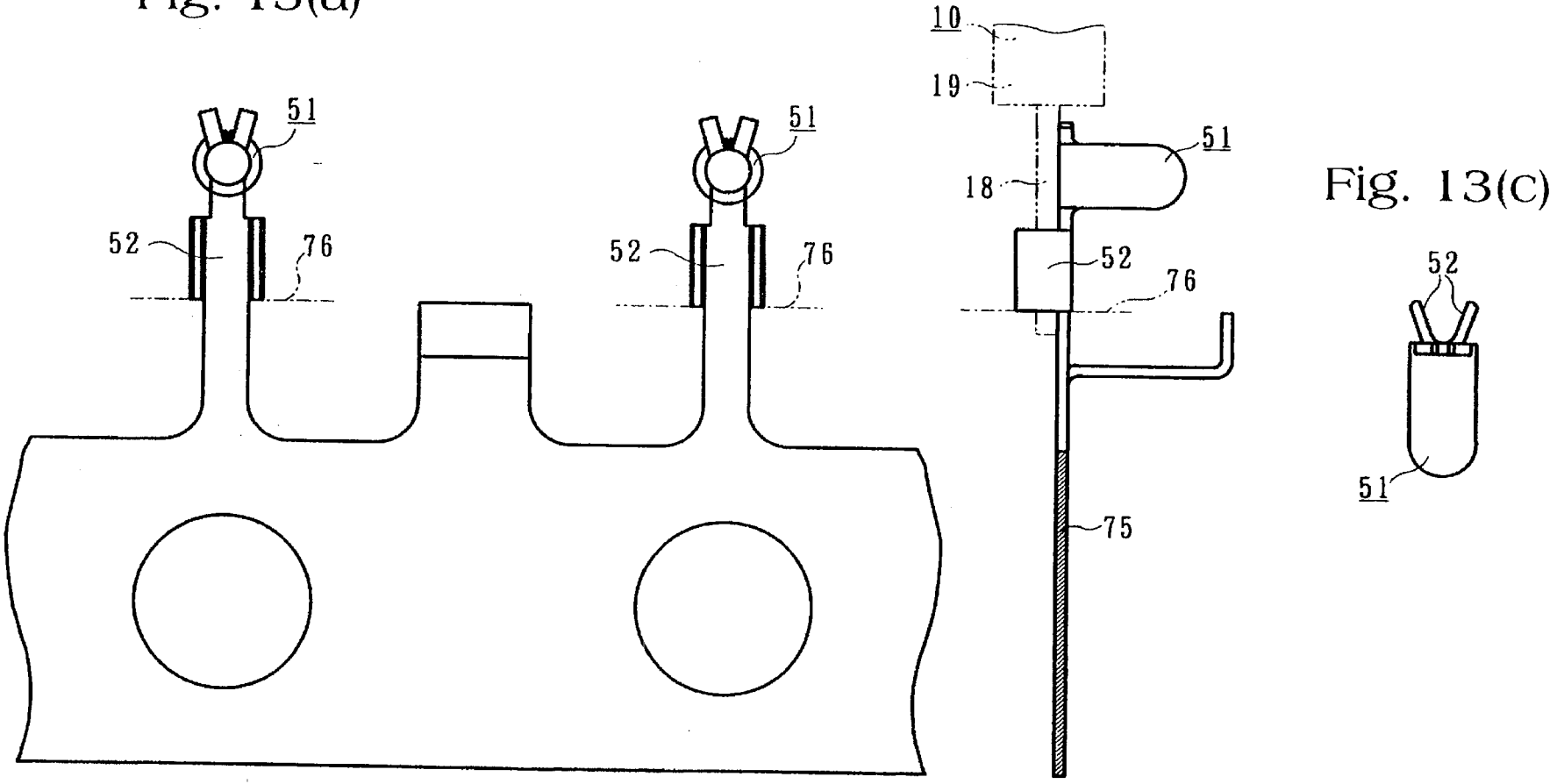
FIG. 13 is an enlarged view of the central contact as shown in FIG. 8 before its assembling, in which (a) is an explanatory drawing showing numerous central contacts as supported by a carrier, (b) a right side elevation view of (a), and (c) an explanatory drawing showing a central contact isolated from the carrier.

Before assembling the central contact 51 has been formed as shown in FIG. 13 (*a*) to (*c*). The central contact 51 has been shaped into cylindrical form with one side closed in hemispherical shape and other side opened on the edge of which the conductor crimp portion 52 has been formed into one piece. A number of the central contact 51 thus provided have been mounted on the carrier 75.

Figure 14:
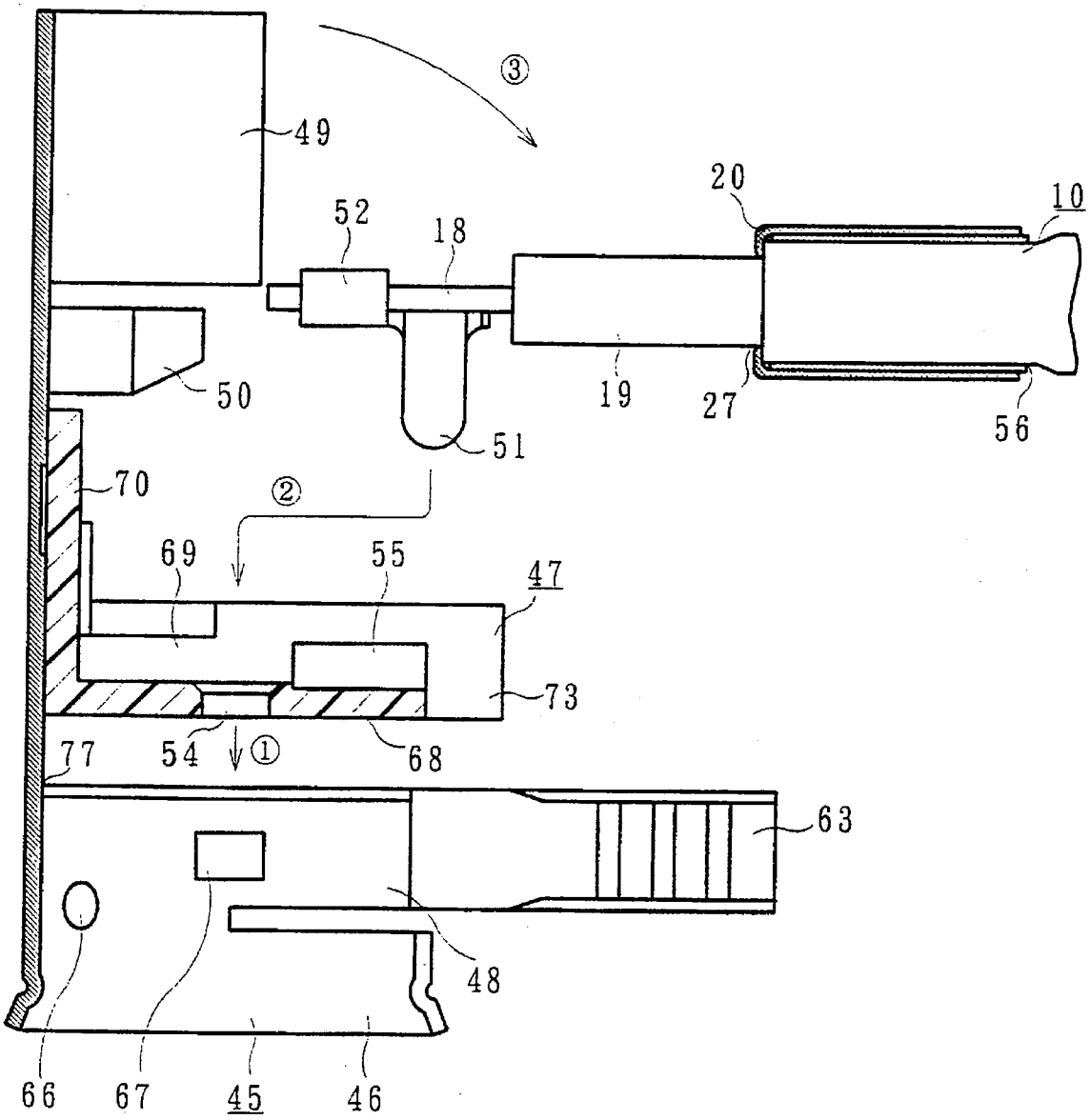
FIG. 14 is an explanatory drawing to explain how to assemble the plug as shown in FIG. 8.

Referring now to FIG. 13 (*c*) to (*c*) and FIG. 14, we will explain the assembling process of the plug shown in FIG. 7.

(1) The coaxial cable 10 is cut into required length. Two-step stripping using a stripper exposes the respective parts of the central conductor 18 and braid 20 from one side of the coaxial cable 10.

(2) Then the sleeve 58 is fitted into the outside of the casing 27 of the coaxial cable 10, and fixed temporarily therewith by caulking.

(3) Then the exposed braid 20 of the coaxial cable 10 is folded over outside the sleeve 56. After crimping the central conductor 18 of the coaxial cable 10 to the conductor crimp portion 52 of the central contact 51 by means of an automatic machine, the conductor crimp portion 52 is cut off the carrier 75 by cutting along the cutting line 76 as shown in FIG. 13 (*b*).

(4) As shown by a mark ④ in FIG. 14, the body 68 of the insulator 47 is mounted into the insulator holding portion 48 of the shield cover 45, when the concave engaging portion 74 as formed on the outer face of the insulator 47 is engaged with the convex engaging portion 67.

(5) Then, as shown by a mark ② in FIG. 14, the central contact 51 press-fitted to the coaxial cable 10 is inserted into the contact insertion hole 54 of the insulator 47 with the edge portion projected into the shell 46, whereby the conductor crimp portion 52 of the central contact 51 and the exposed central conductor 18 of the coaxial cable 10 are housed into the concave housing portion 69 of the insulator 47, and the insulator 19 of the coaxial cable 10 is guided by the projected guide pieces 73 and 73 of the insulator 47 to be housed into the concave housing portion 55.

(6) Then, as shown by a mark ③ in FIG. 14, the upper portion of the shield cover 45 is folded 90° clockwise as viewed in the figure about the folding portion 77, and the insulator crimp portion 40 is temporarily caulked in such a way to crimp the insulator crimp portion 40 to the pressure pieces 63 and 63 of the shield cover 45 and to the projected guide pieces 73 and 73 of the insulator 47. At the same time the folding tongue 70 is folded 90° to form the housing portion 53 with the concave housing portion 69.

(7) Then, caulking the braid crimp portion 49 of the shield cover 45 will crimp this portion 49 onto the exterior of the folded braid 20 of the coaxial cable 10.

(8) Fitting the locking spring 59 into the outer portion of the shell 46 of the shield cover 45 will reinforce the spring force of the shell 46, when the locking spring 59 will be positioned in its predetermined position by the projected engaging portion 66 and 66 of the shield cover 45.

Thus, the plug as shown in FIGS. 7 and 8 are provided. Now an embodiment of the receptacle 80 as shown in FIG. 7 will be explained referring to FIGS. 15 to 21.

In FIGS. 15 to 21 like reference characters and numerals denotes like parts in FIG. 1 to 6.

Figure 15A:
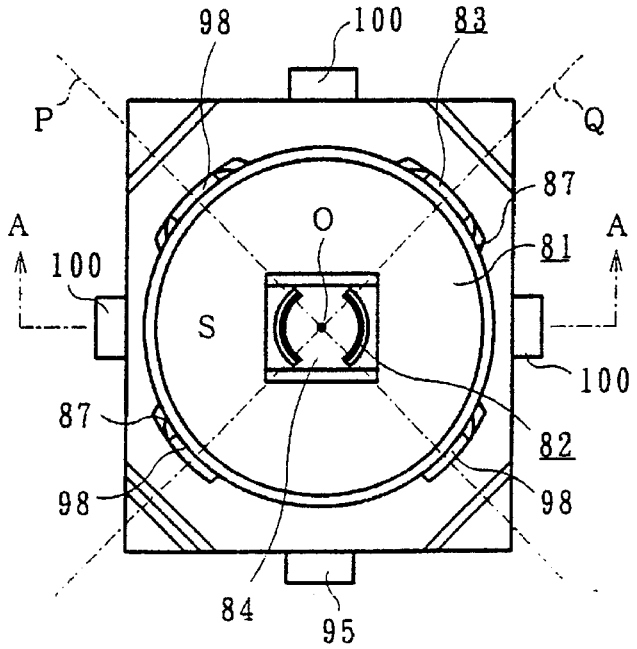
FIG. 15 represents, in reduced scale, the receptacle as shown in FIG. 7, in which (a) is a plan view, (b) a frontal elevation view, and (c) a bottom plan view.
Figure 15B:
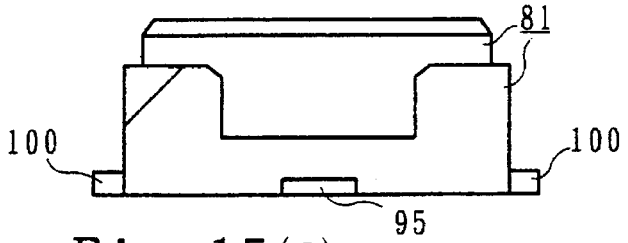
Figure 15C:
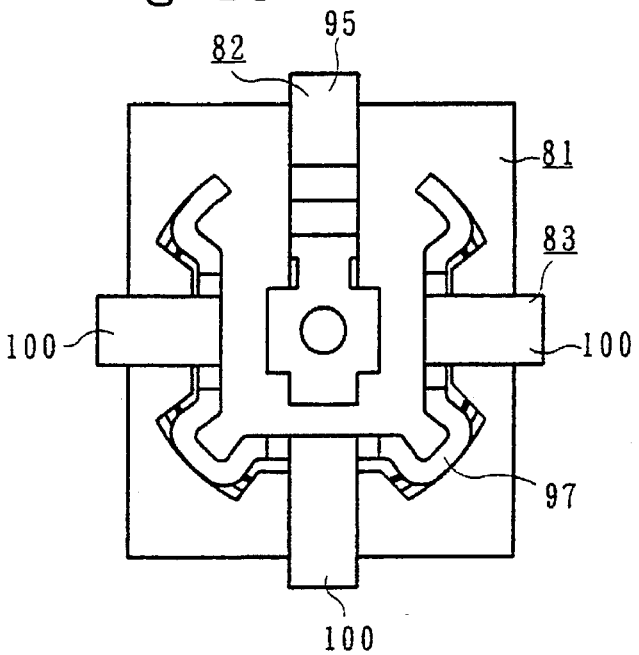
Figure 16A:
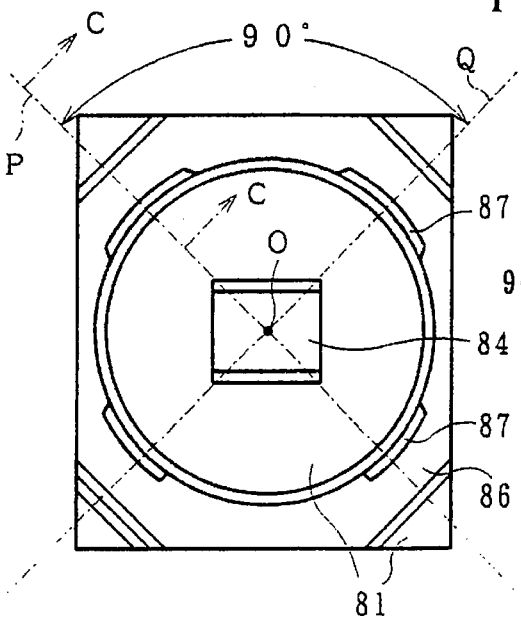
FIG. 16 illustrates the insulator as shown in FIG. 15, in which (a) is a plan view, (b) a frontal elevation view, (c) a bottom plan view, (d) a left side elevation view (a), (e) the A—A cross-sectional view of (c), (f) the B—B cross-sectional view of (c), and (g) the C—C cross-sectional view of (a).
Figure 16D:
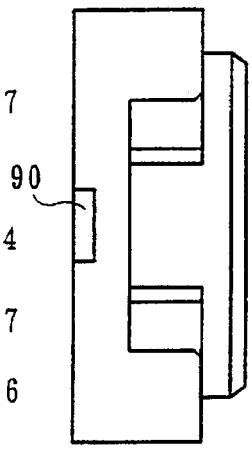
Figure 16E:
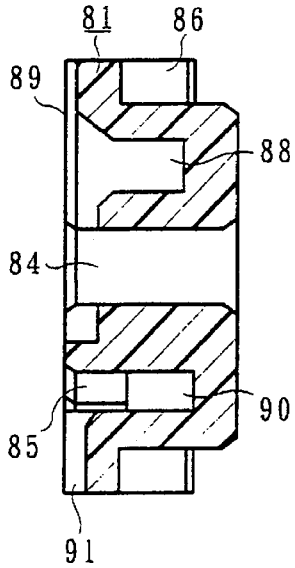
Figure 16B:
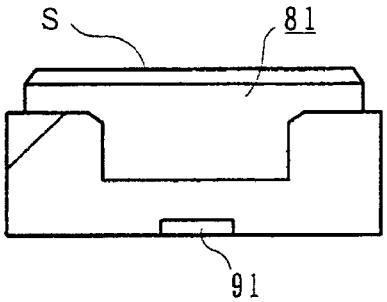
Figure 16F:
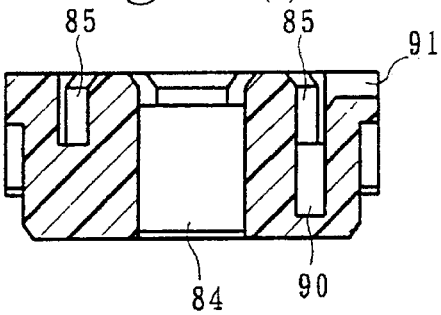
Figure 16C:
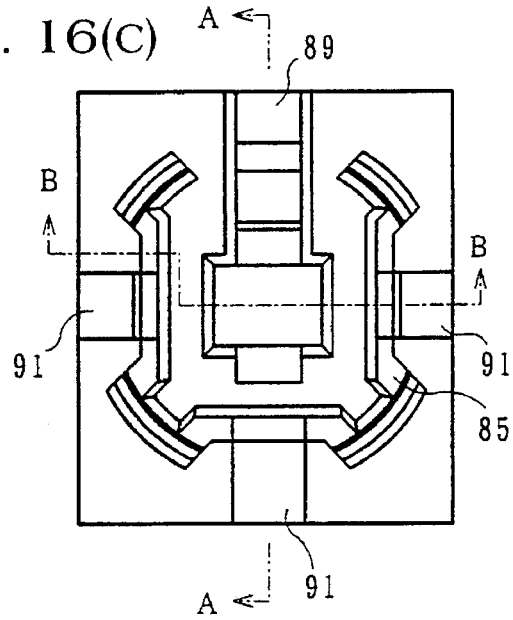
Figure 16G:
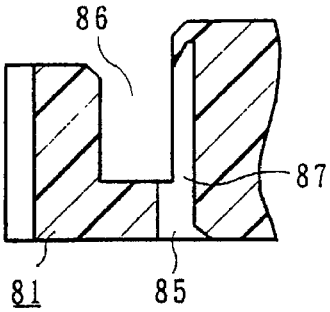
Figure 17A:
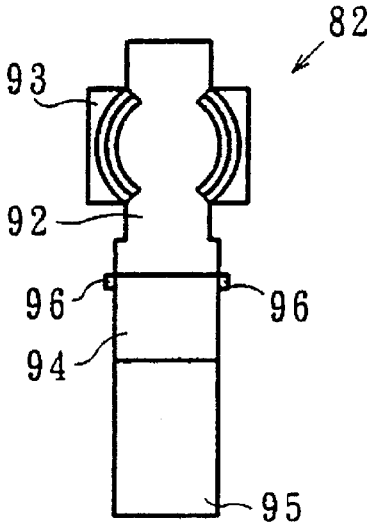
FIG. 17 depicts an enlarged view of the central contact as shown in FIG. 15 where (a) is a plan view, (b) a rear elevation view, (c) a bottom plan view, (d) a right side elevation view of (a), (e) the A—A sectional view of (d), and (f) the B—B sectional view of (d).
Figure 17D:
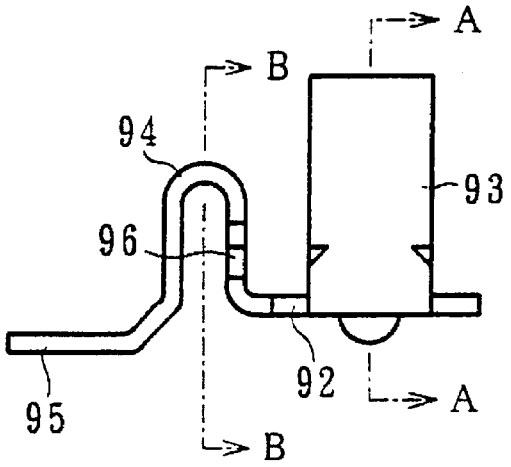
Figure 17B:
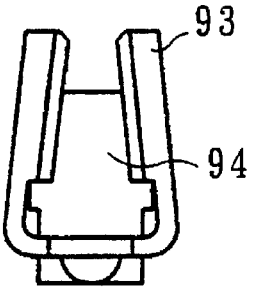
Figure 17E:
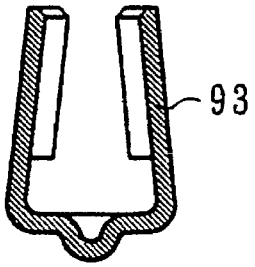
Figure 17C:
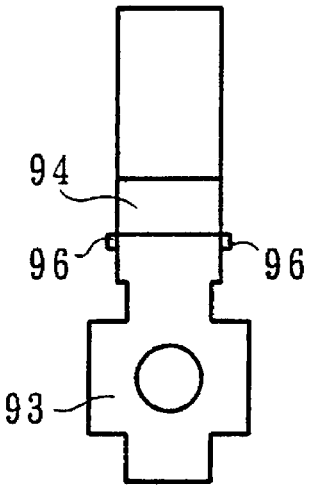
Figure 17F:
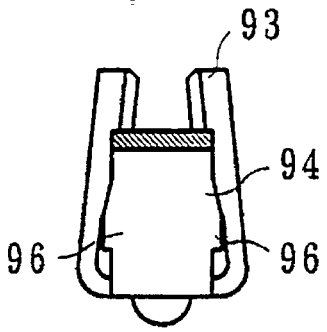
Figure 18A:
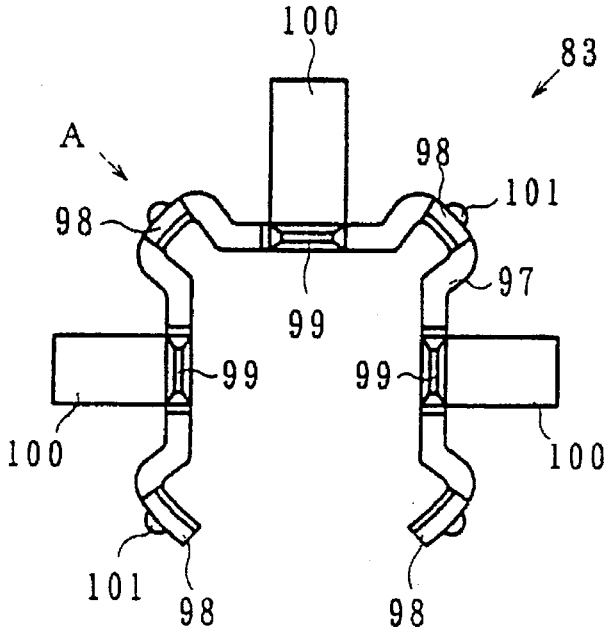
FIG. 18 illustrates the shell as shown in FIG. 15 where (a) is a plan view, (b) a frontal elevation view, (c) a partially enlarged shell as viewed from the direction A of (a), and (d) the B—B cross-sectional view of (c).
Figure 18B:
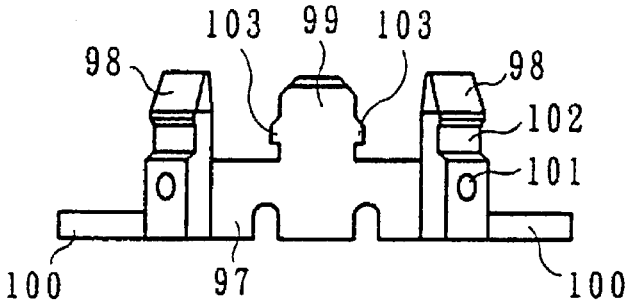
Figure 18C:
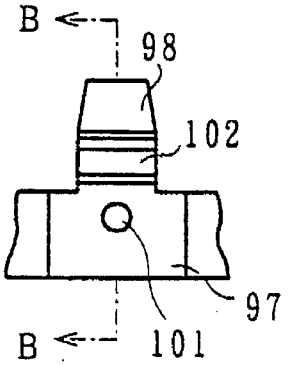
Figure 18D:
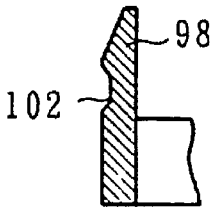

In FIGS. 7 and 15 (*a*), (*b*), and (*c*), the numeral 81 represents an insulator forming a housing, 82 the central contact formed by female contact, and 83 the shell. The central contact 82 and shell 83 have been press-fitted and fastened into the contact housing port 84 and shell housing concave portion 84 of the insulator 81 from the bottom of the insulator 81 (from the bottom in FIG. 7).

The insulator 81 is arranged into one piece by molding, for instance, a synthetic resin as shown in FIG. 16 (*a*) to (*g*) through.

That is, provided in the central portion of the insulator 81 is a substantially prismatic contact housing port 84 passing vertically through, on the outer circumference of which are provided sequentially a shell housing concave portion 85 whose transverse cross section is rectangle with one side lost and a plug, and a plug fitting concave portion 86 whose transverse cross section is substantially circular.

The shell housing concave portion 85 is formed open into the bottom side of the insulator 81 (left side in FIG. 16 (*e*)) and the plug fitting concave portion 86 is formed open into the upper portion of the insulator 81 (right side in FIG. 16 (*e*)). Provided on the four upper corners of the shell housing concave portion 85 of the insulator 81 are arc-shaped ports 87 to 87 that are open into the plug fitting concave portion 86 and penetrate into the upper portion. Arranged on the bottom of the insulator 81 are the prismatic engaging concave portion 88 in communication with the contact housing port 84 and a notched portion 89 in communication with this concave portion 88 as well as the engaging concave portions 90 to 90 in communication with the shell housing concave portion 85 and the notched portions 91 to 91 in communication with these engaging concave portions 90 to 90.

The central contact 82 is made from, for instance, copper alloy plate by stamping, folding, and gold-plating whose construction is as shown in FIG. 17 (*a*) to (*f*). The central contact 82 comprises a strip-shaped base plate 92, a female type contact 93 formed on this base plate 92 into one piece, and those engaging portion 94 and terminal 95 which have been consecutively formed on one side of the base plate 92.

The female contact 93 is so designed that the opposed side walls rising from both sides of the base plate 92 are shaped into taper U letter with the transverse cross section of the walls shaped into substantially quadrantal arcs. The engaging portion 94 has been made from the strip-formed plate folded into reverse U letter form.

The female contact 93 and the engaging portion 94 of the central contact 82 are press-fitted into the contact housing port 84 and engaging concave portion 88 from the bottom of the insulator 81 (under side in FIG. 7) wherein the mating projections 96 and 96 formed in the engaging portion 94 are snapped into the internal wall of the engaging concave portion 88 to prevent slip-out.

The terminal 95 of the central contact 82 protrudes outside in engagement with the notched portion 89 of the insulator 81. If the material of the central contact 82 is changed from universal one (for example, phosphor bronze)

into some other materials (for example, beryllium bronze with great spring constant) the height of the female contact 93 can be reduced, lessening at the same time the height Hr of the insulator 81.

The shell 83 can be made from, for instance, a copper alloy plate stamped, folded and then gold-plated whose construction is shown in FIG. 18 (*a*) to (*d*). That is, the shell 83 comprises the shell body 97 shaped, into a quadrilateral form with one side lost, by folding a substantially strip-formed conductive plate, contact tongues 98 to 98 projectedly constructed into one piece on the upper parts of the four corners of the shell body 97, the engaging tongues 99 to 99 projectedly formed into one piece on the upper intermediate portions of the three sides of the shell body 97, and the terminals 100 to 100 projectedly formed by folding the three sides of the shell body 97 outwardly from their lower intermediate portions.

The mating projections 101 to 101 are projectedly provided on the outer portion of the four corners of the shell body 97, and engaging grooves 102 and 102 are provided for engagement with the fitting plug 44 on the outer portion of the contact tongues 98 to 98.

The shell body 97 and engaging tongues 99 to 99 of the shell 83 are press-fitted and secured into the shell housing concave portions 85 and engaging concave portion 88 to 88 from the bottom side of the insulator 81 (from the under side in FIG. 7). In this press-fit and secured state, the shell 83 and the insulator 81 are constructed into geometrical form that meets the following conditions.

That is, the top plane S on the plug fitting side (upper side in FIG. 7) of the insulator 81 of the receptacle 80 is shaped into planar form outward (upper side in FIG. 7) from the top face on the plug engaging side of the contact tongues 98 to 98 of the shell 83.

The outside of the contact tongues 98 to 98 of the shell 83 of the receptacle 80 protrudes into the plug fitting concave portion 86 from the arc-shaped ports 87 to 87 of the insulator 81 in such a way that it can contact the shell 46 of the plug 44 which is fitted into the plug fitting concave portion 86. The mating projections 101 to 101 of the shell body 97 and the mating projections 103 to 103 of the mating tongues 99 to 99 are snapped into the inner wall of the shell housing concave portion 85 and engaging concave portions 88 to 88 to prevent slip-out.

The contact tongues 98 to 98 on the four corners of the shell body 97 belonging to the receptacle 80 are on the straight lines P and Q intersecting with each other and passing through the center axis 0 of the central contact 82 and equidistantly positioned from this central axis 0 as shown in FIG. 15 (*a*).

Figure 19B:
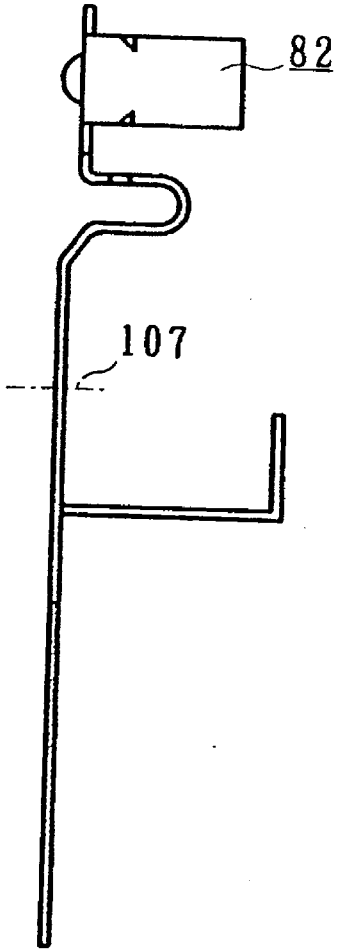
FIG. 19 shows up the central contact as shown in FIG. 17 that is held by plural carriers, in which (a) is a partial bottom plan view and (b) the right side elevation view of (a).
Figure 19A:
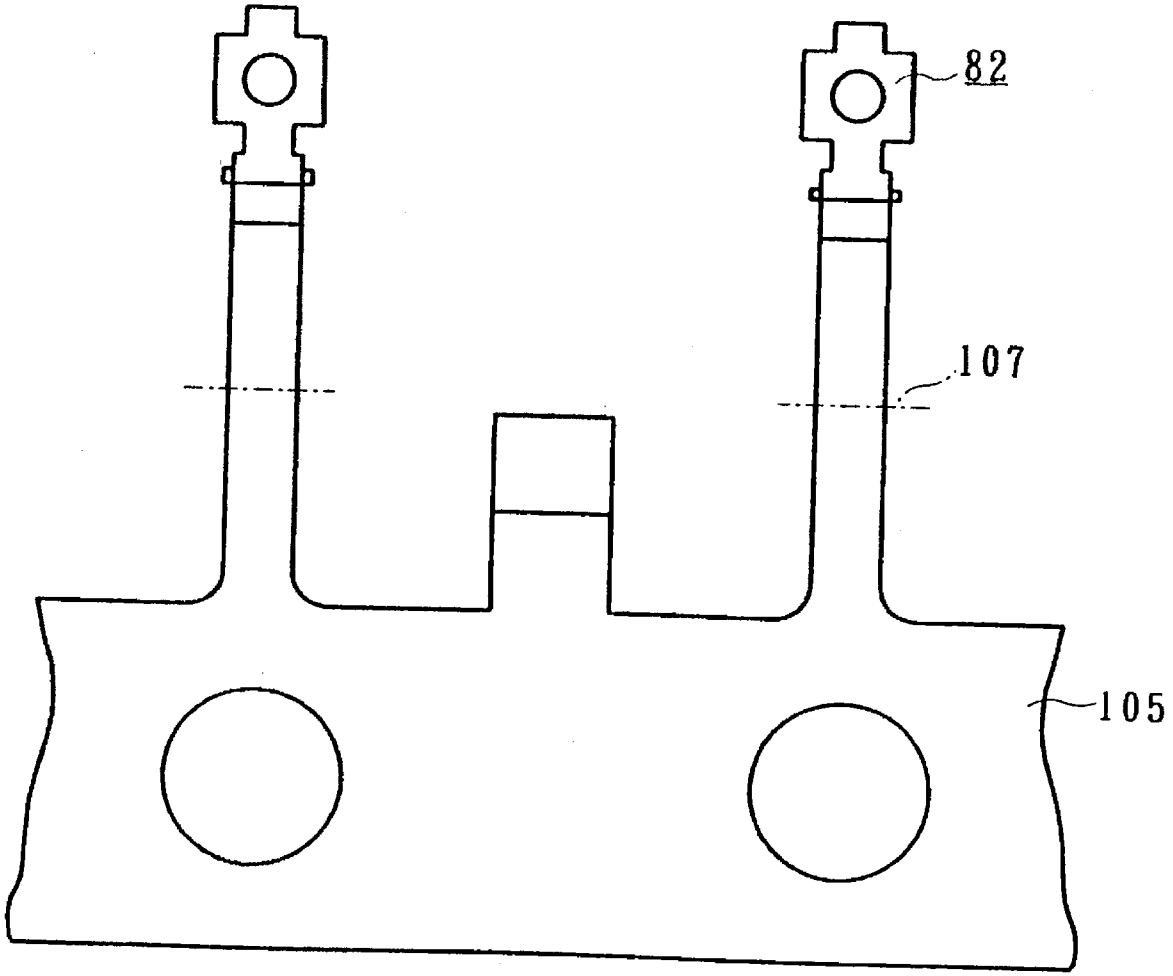
Figure 20B:
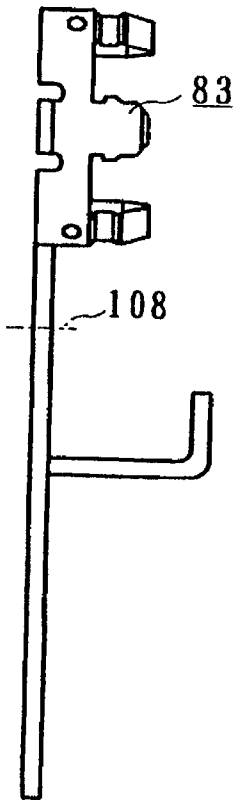
FIG. 20 shows up the shell as shown in FIG. 18 that is held by plural carriers, in which (a) is a partial bottom plan view and (b) the right side elevation view of (a).
Figure 20A:
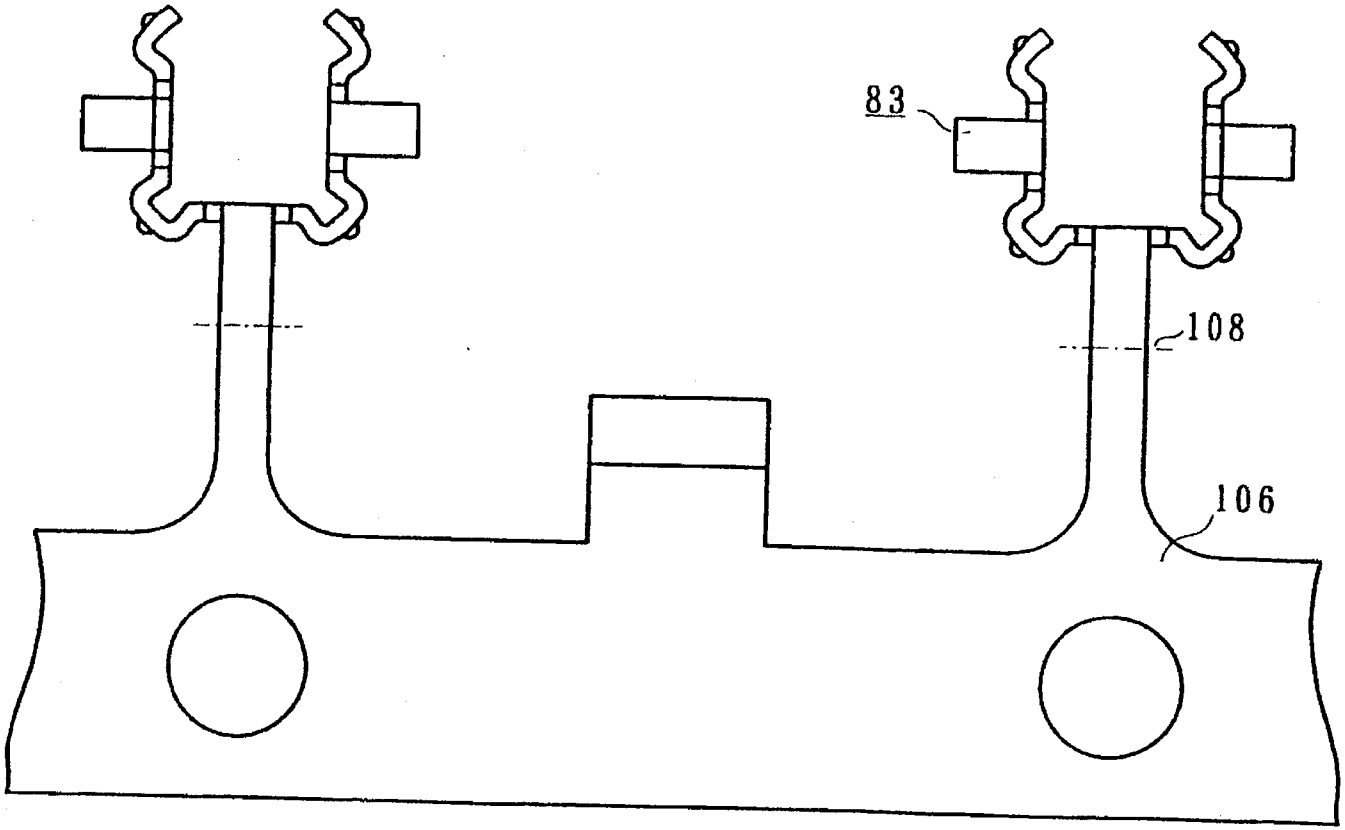

Now we will explain how to assemble the receptacle 80 shown in FIGS. 7 and 15 referring to FIG. 19 (*a*), (*b*), FIG. 20 (*a*) and (*b*).

(1) The central contact 82 and the shell 83 are press-fitted and secured from the bottom side (under side in FIG. 7 and FIG. 16 (*b*)) of the insulator 81. The assembling work is thus easier compared with the prior art wherein the central contact and shell have been press-fitted and secured from different directions (for example, from upward and downward) of the insulator 81. After this press-fitting and fixation, into the insulator 81, of the central contact 82 and the shell 83, the top face of the contact tongue 98 of the shell 83 is situated inward of the top face S of the plug fitting side (upper side in FIG. 7 and FIG. 16 (*b*)) of the insulator 81.

The press-fitting and fixation of the central contact 82 and shell 83 into the insulator 81 may be performed in sequential order, one (for instance, shell 83) first and the other (for instance, central contact 82) second or else simultaneously. At that time, the central contact 82 and shell 83 are connected with the carriers 105 and 106 respectively as shown in FIG. 19 (*a*) and (*b*) as well as in FIG. 20 (*a*) and (*b*).

(2) Then, the central contact 82 shall be applied flux preventing agent.

(3) The central contact 82 and shell 83 are cut off the carriers 105 and 106 along the cutting lines 107 and 108 thus completing the assembling work.

Figure 21:
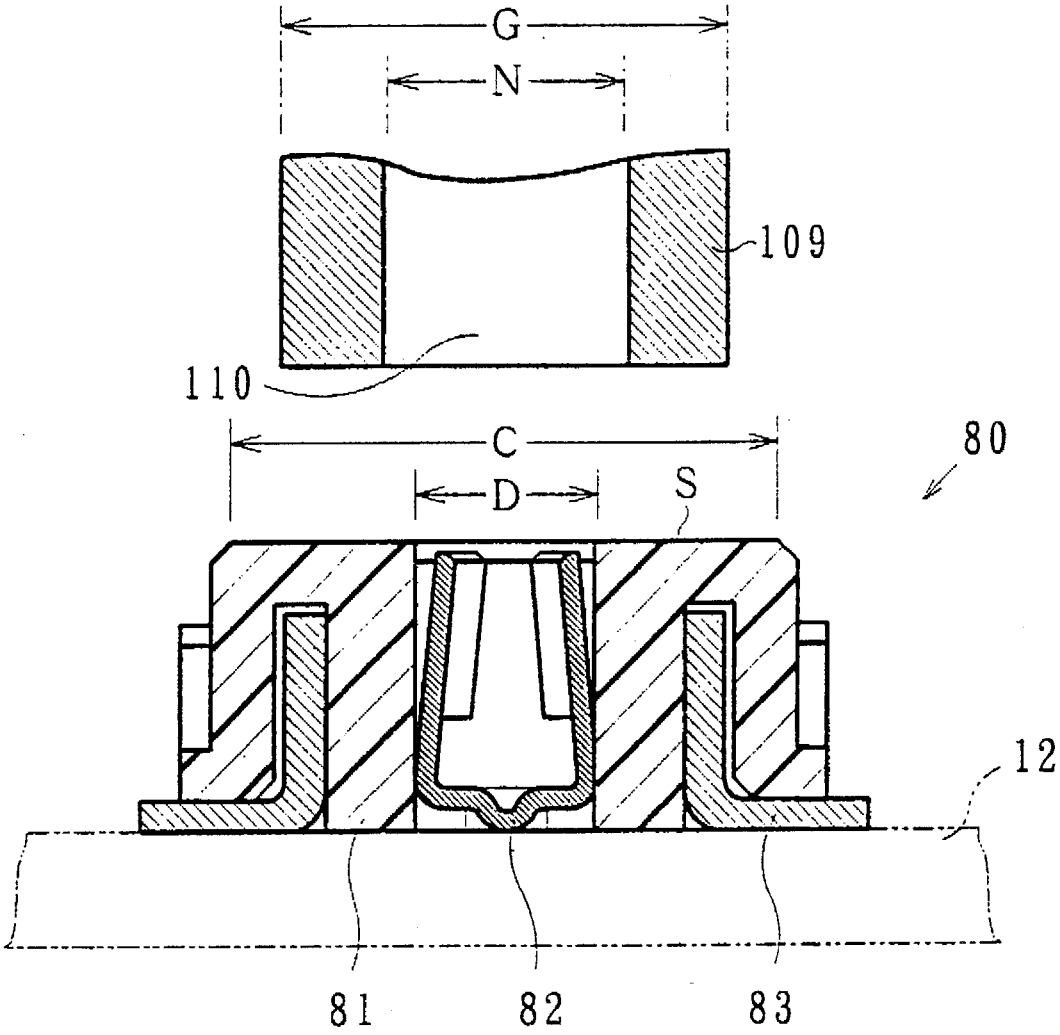
FIG. 21 is an explanatory drawing that shows how to mount the receptacle as shown in FIG. 7 onto a substrate using the adsorption nozzle of the automatic mounting machine.

Referring now to FIG. 21 we will explain a high-speed mounting of the receptacle 80 thus assembled onto the substrate 12 using an automatic mounting machine (for example, surface mounter).

The top face of the adsorbing nozzle 109 is made to contact the top face S of the insulator 81 of the receptacle 80 fed to parts feeding portion to vent air from the inlet port 110 and to adsorb the receptacle 80.

Since under these conditions the top face S of the insulator 81 is situated outside the top face of the central contact 82 and the shell 83 (upper face side in FIG. 20), the degree of freedom can be greater for designing the outer diameter G and inner diameter N of the adsorbing nozzle 109 thereby enlarging the contact area with the adsorbing nozzle 109 and the adsorbing area of the nozzle 109 itself.

Let the minimum outside dimension (for example, outer diameter) and the maximum inside dimension (for example, the maximum inner diameter of the contact housing port 84) of the top plane S on the plug fitting side of the insulator 81, C and D respectively. To perform due adsorption, the outer diameter G and inner diameter N of the adsorbing nozzle 109 have only to satisfy the condition: $G>D$ and $N \leqq C$. It is because the area of the top plane S of the insulator 81 in contact with the top face of the adsorbing nozzle 109 can be enlarged to widen the range of the values of the outer diameter G and inner diameter N of the adsorbing nozzle 109. Then the adsorbing nozzle 109 carries the receptacle 80 adsorbed to the prescribed position on the substrate 12 and release the adsorption to set the receptacle 80 at the predetermined position on the substrate 12, when the adsorption stability of the receptacle 80 under high-speed mounting using the automatic mounter can be enhanced by enlarging the area of the top plane S of the insulator 81 that contacts the top face of the adsorbing nozzle 109.

Then use of such soldering units as reflow unit (for example, infrared reflower) will allow to solder the terminal 95 of the central contact 82 and the terminals 100 to 100 of the shell 83 belonging to the receptacle 80 onto the terminals corresponding to the wiring pattern on the substrate 12.

Now explained is the fitting action of the plug 44 into the receptacle 80 referring to FIG. 7.

Fitting the central contact 51 connected to the end of the coaxial cable 10 of the plug 44 and shell 46 into the central contact 82 and shell 83 of the receptacle 80 surface-mounted on the substrate 12 will electrically connect the coaxial cable 10 with the substrate 12.

As has thus far been described, this invention constructs the central contact of the plug connected to the coaxial cable by means of male type contact, on the one hand, and on the other, the central contact of the receptacle surface-mounted on the substrate by female type contact. Compared with the conventional plug central contact consisting of female contact having a slit to obtain elasticity, the contacts by this invention enable to render smaller the height Hp of the shield cover shell of the plug and the height of the surface-mounted coaxial connector from the face of the substrate thereby improving the space-saving feature.

In the foregoing embodiment, the conductor press-fit portion incorporated into the central contact is press-fitted into the central conductor thus materializing electrical connection between the plug central contact and coaxial cable central conductor, simplifying thus the press-fit operation, but this invention may not be limited to this embodiment. For example, this invention is effective in such electrical connection of the plug central contact with the coaxial cable central conductor as by soldering.

In the above embodiment, the position at which the plug central contact connects electrically with the coaxial cable central conductor is made to oppose the fixation portion of the plug with the coaxial cable as seen from the central; contact; thereby lessening the length Lp from the center line of the plug central contact to the bottom end of the shield case, but this invention may not be limited to this embodiment. For example, this invention is effective also in the case, as was with the conventional one shown in FIG. 2, where the position of the electrical connection between the plug central contact and the coaxial cable central conductor is situated on the same side with the fixing portion of the plug and coaxial cable as seen from the central contact.

In the foregoing embodiment, the coaxial cable to be connected to the plug is formed by exposing sequentially the parts of the central conductor and braid from one end of the cable, the braid thus exposed being folded over the outside of the sleeve fitted into the outer portion of the casing, the braid press-fit portion of the shield case being press-fitted into the outer portion of the folded braid of the coaxial cable, thereby reducing the number of press-fit portions required for the plug and lessening the length Lp from the center line of the central contact to the bottom end of the shield case, but this invention is not limited to this embodiment. For instance, this invention does not lose its effectiveness also for the plug wherein the press-fit portions are constructed at two points: braid press-fit and casing press-fit portions as was the case with the prior art shown in FIG. 2.

In the foregoing embodiment, the assembling work has been facilitated by press-fitting and securing, into the insulator, the central contact and shell of the receptacle only from one side (for instance, from the bottom), this invention is not limited to this embodiment. This invention is effective also in such a case where the receptacle central contact and shell may be press-fitted and secured into insulator from different surface sides (for example, top side and bottom side) of the insulator as was the conventional case shown in FIG. 2.

In the foregoing embodiment, the insulator of receptacle has been made from a single insulator body whose top plane S on the plug fitting side is situated outside the top face of the shell, but this invention is not limited to this embodiment. This invention is effective also in the case as shown in FIG. 22 or FIG. 23 where the insulator plane S on the plug fitting side is formed into planar shape positioned at the same plane with the top plane of the shell.

Figure 22A:
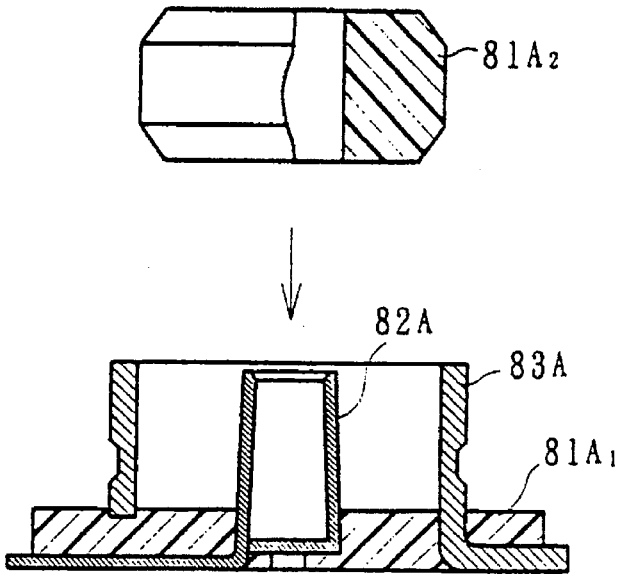
FIG. 22 shows up the receptacle in the second embodiment of the surface mount type coaxial connector, in which (a) is an explanatory drawing that shows how to assemble, (b) a plan view after the assembling, and (c) the A—A cross sectional view of (b)
Figure 22B:
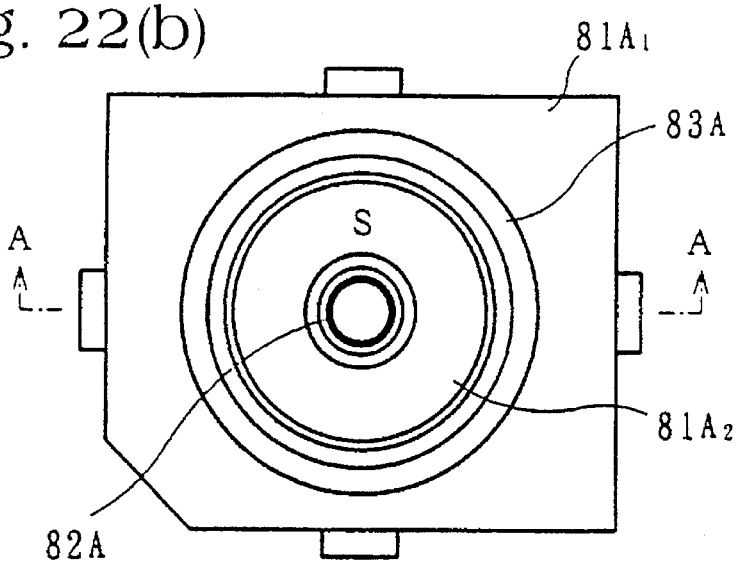
Figure 22C:
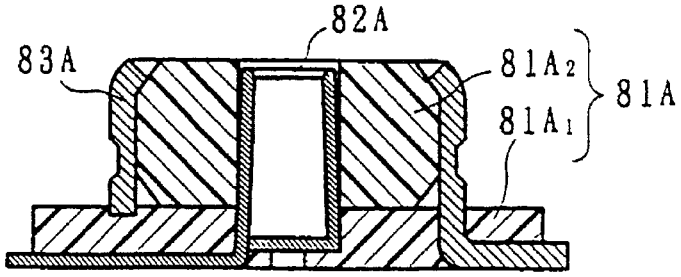

This invention does not lose its effectiveness also in such a case where, as shown in FIG. 22 (*a*), the insulator 81A is composed of the first insulating body 81A1 and the second insulating body 81A2, the central contact 82A and shell 83A are made into one piece when molding the first insulating body 81A, then the second insulating body 81A2 is inserted, and subsequently, as shown in FIG. 22 (*b*) and (*c*), the second insulating body 81A2 can be held by caulking the end of the shell 83A, when the adsorbing contact face with the adsorbing nozzle of the automatic mounter may be made the total face of the top plane S on the plug fitting side of the insulating body 81A by forming the top plane on the plug fitting side of the second insulating body 81A2 in such a way that S comes on the same plane with the top plane of the shell 83A.

Figure 23A:
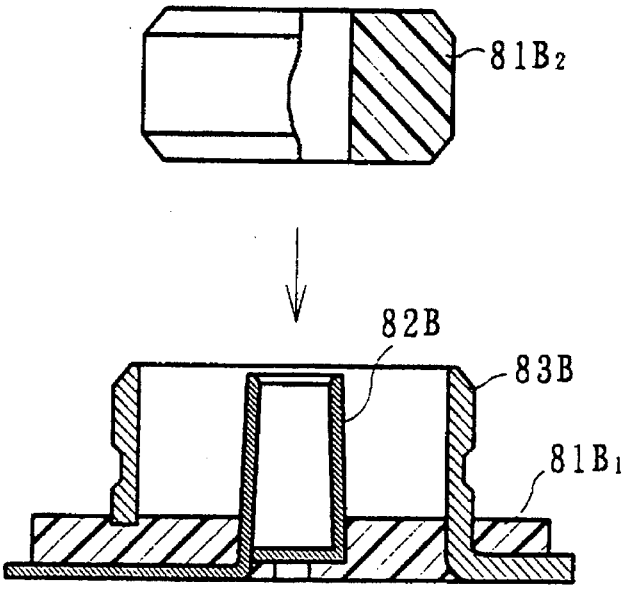
FIG. 23 shows up the receptacle in the third embodiment of the surface mount type coaxial connector according to this invention, in which (a) is an explanatory drawing that shows how to assemble, (b) a plan view after the assembling, and (c) the A—A cross sectional view of (b).
Figure 23B:
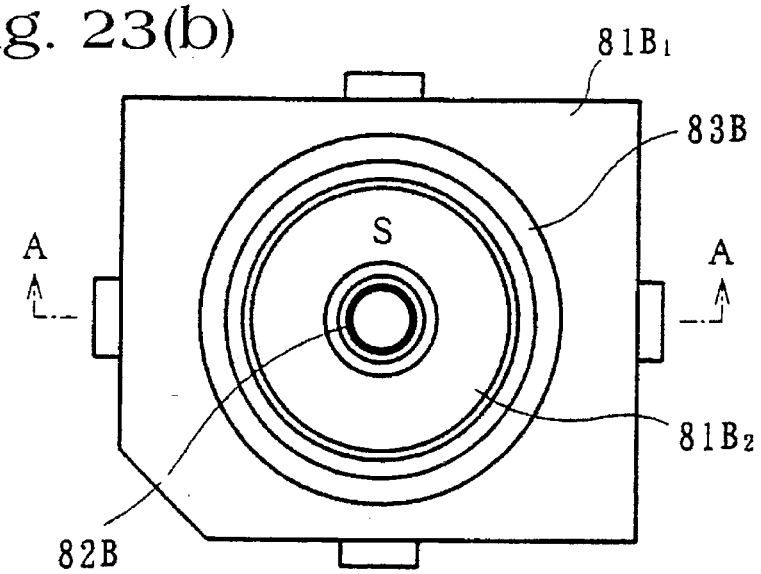
Figure 23C:
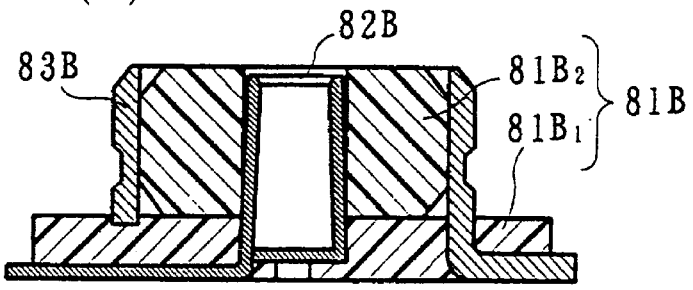

This invention is useful also in the case, where, as shown in FIG. 23 (*b*) and (*c*), the second insulating body 81B2 is secured into the shell 83B by constructing the insulator 81B with the first insulating body 81B1 and second insulating body 81B2 and making the central contact 82B and shell 83B into one piece when molding the first insulating body 81B1 thereby press-fitting the second insulating body 81B2 thereinto as shown in FIG. 23 (*a*), when the adsorbing contact face with the adsorbing nozzle of the automatic mounter is made to be the total face of the top plane S on the plug fitting side of the insulating body 81B by forming the top plane S on the plug fitting side of the second insulating body 81B2 in such a way that S should come on the same plane with the top plane of the shell 83B.

Figure 1:
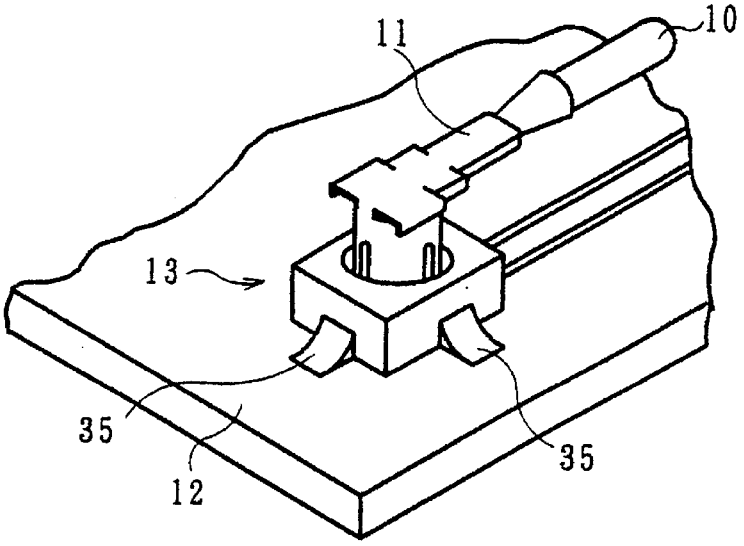
Fig. 1 PRIOR ART
FIG. 1 is a perspective illustration of the surface mount type coaxial connector that connects the axial cable to the substrate in a prior art.
Figure 2:
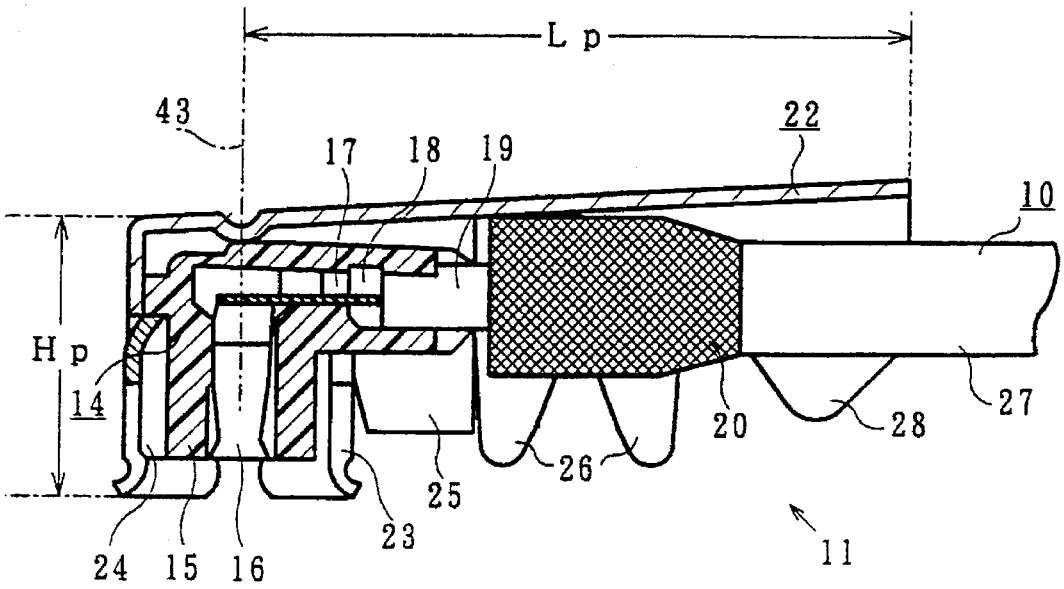
Fig. 2 PRIOR ART
FIG. 2 represents an enlarged cross-sectional view of the plug as shown in FIG. 1 just before the completion of its assembling.
Figure 3A:
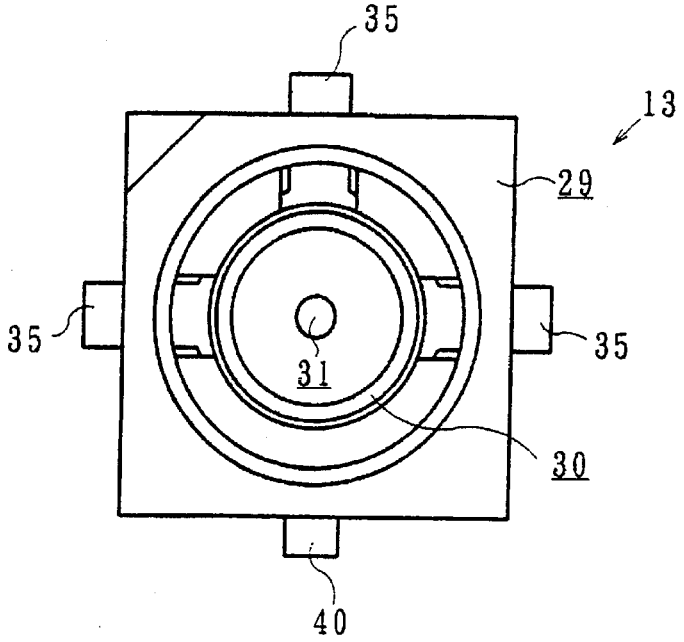
Fig. 3(a) PRIOR ART
FIG. 3 shows an enlarged view of the receptacle as Shown in FIG. 1 in which (a) is a plan view, (b) a front elevation with a part thereof as cross-sectional view, and (c) a bottom plan view.
Figure 3B:
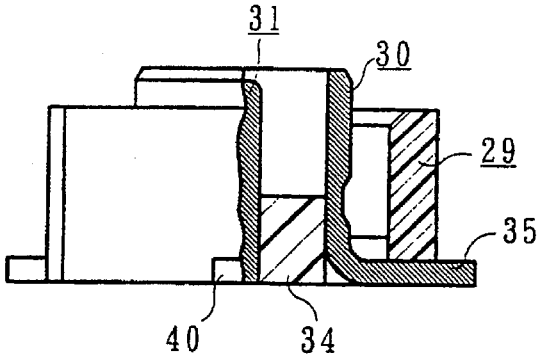
Fig. 3(b) PRIOR ART
Figure 3C:
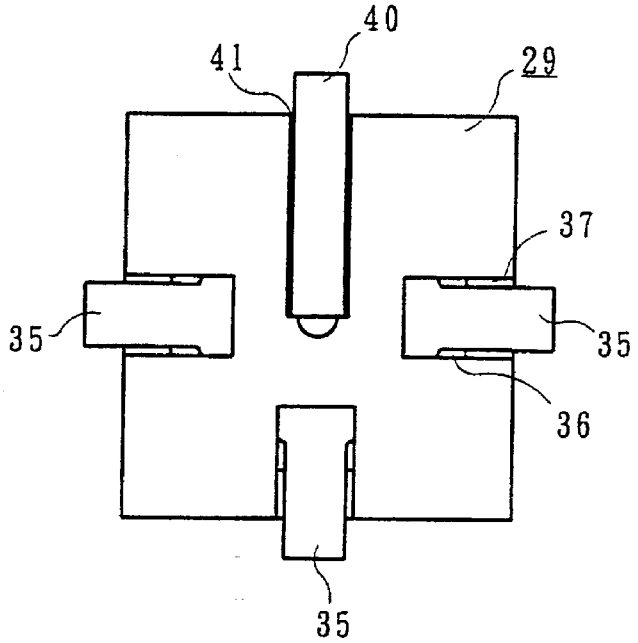
Fig. 3(c) PRIOR ART
Figure 4:
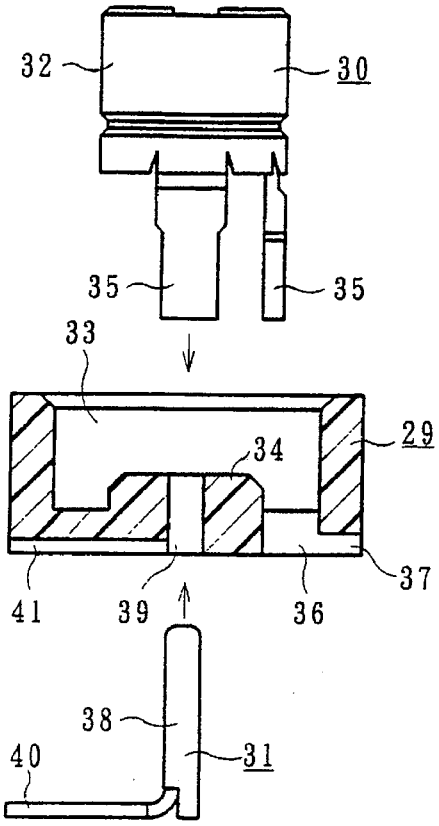
Fig. 4 PRIOR ART
FIG. 4 is an explanatory drawing that shows up how to assemble the receptacle as shown in FIG. 1.
Figure 5:
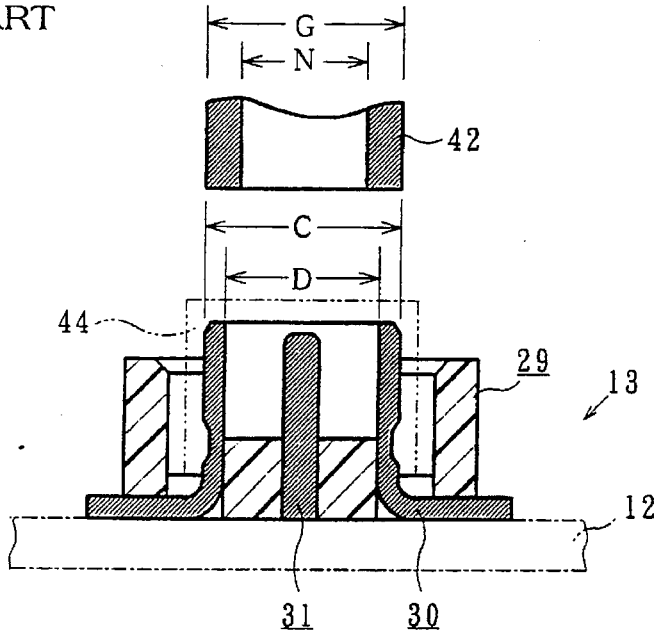
Fig. 5 PRIOR ART
FIG. 5 is another explanatory drawing that indicates how to mount the receptacle as shown in FIG. 1 onto a substrate using the adsorption nozzle of an automatic mounting machine.
Figure 6:
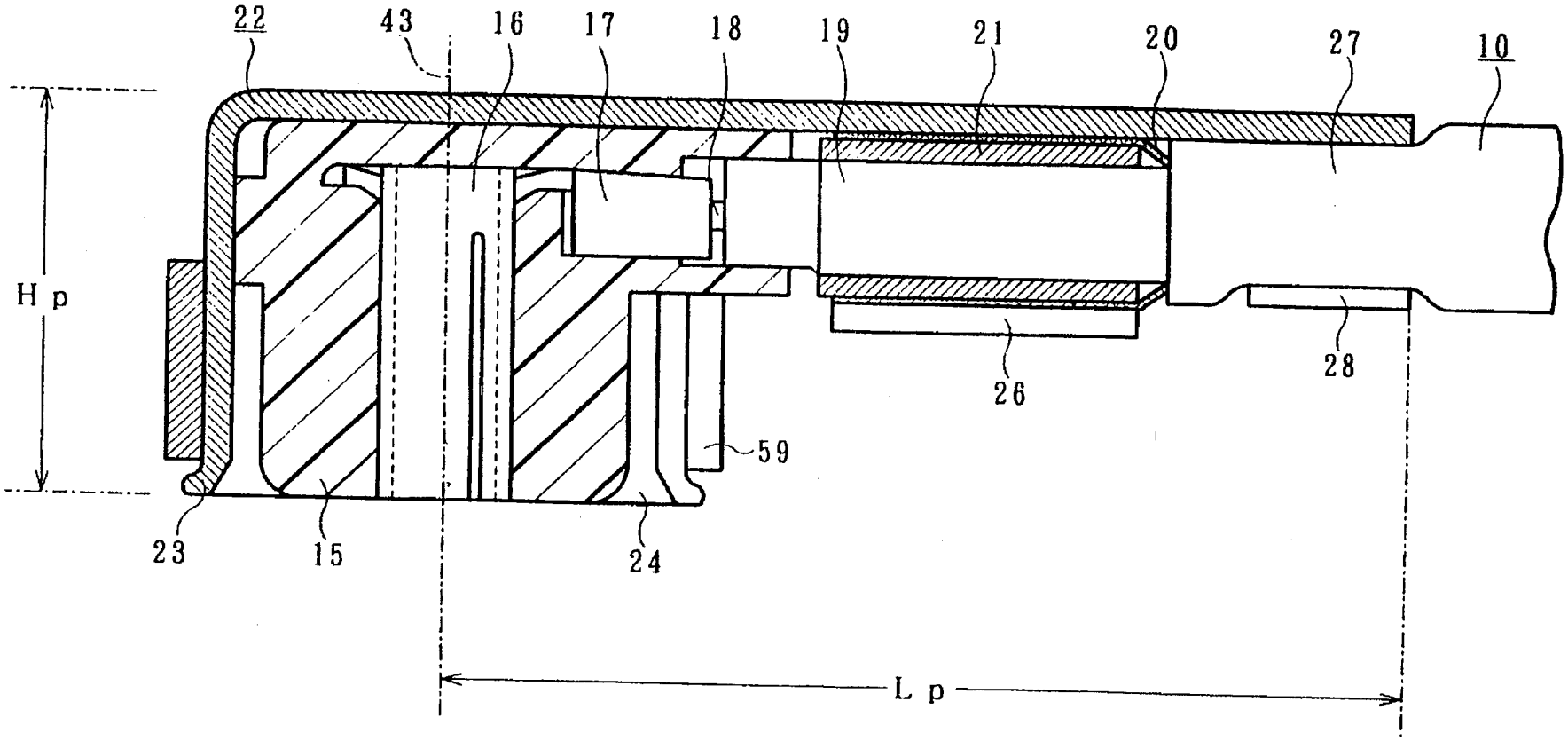
Fig. 6 PRIOR ART
FIG. 6 depicts an enlarged cross-sectional view of the plug in another prior art.

In the foregoing embodiment the plane S on the plug fitting side of the receptacle insulator has been so formed as to be outside the top plane of the shell or on the same plane with the top plane of the shell, but this invention is not limited to such an embodiment. This invention is also useful in an example where the top plane S on the plug fitting side of the receptacle insulator is inside (namely, substrate side) the top plane of the shell as shown in FIG. 2.

What is claimed is:

1. A surface-mount type coaxial connector comprising: a plug connected to the end of a coaxial cable and a receptacle surface-mounted on a substrate for electrically connecting the coaxial cable with the substrate, said plug having a male central contact and a shell for fitting onto a female central contact and a shell of the receptacle, wherein substantially the entire electrical connection of the male central contact of the plug with a central conductor of the coaxial cable is positioned opposite the fixation portion of the plug into the coaxial cable as seen from the central contact.

2. The surface-mount type coaxial connector as claimed in claim 1 wherein a contact housing port and a shell housing recess are formed into an insulator of the receptacle and that the central contact and shell of the receptacle are press-fitted and secured into the contact housing port and shell housing recess from one side of the insulator.

3. The surface-mount type coaxial connector as claimed in claim 1 wherein the top face on the plug fitting side of the receptacle insulator is formed into a planar shape above the top face of the plug fitting side of the receptacle shell.

4. The surface-mount type coaxial connector as claimed in claim 1 wherein the top face on the plug fitting side of the receptacle insulator is formed on the same plane with the top face of the plug fitting side of the receptacle shell.

5. The surface-mount type coaxial connector of claim 1, wherein the central conductor of the coaxial cable extends across the center line of the male central contact toward the periphery of the plug shell, and the electrical connection of the central conductor and the male central contact comprises a conductor crimp portion engaging the extended central conductor between the male central contact and the periphery of the plug shell.

6. The surface-mount type coaxial connector of claim 5, wherein the coaxial cable includes a braid crimp portion, and the braid crimp portion and the conductor crimp portion are positioned on opposite sides of the center line of the male central contact.

* * * * *